US005563025A

United States Patent [19]

Ishii et al.

[11] Patent Number: 5,563,025

[45] Date of Patent: Oct. 8, 1996

[54] SILVER HALIDE COLOR PHOTOGRAPHIC MATERIAL

[75] Inventors: Yoshio Ishii; Keiji Mihayashi; Masayuki Negoro; Masakazu Morigaki; Hisashi Mikoshiba, all of Kanagawa, Japan

[73] Assignee: Fuji Photo Film Co., Ltd., Kanagawa, Japan

[21] Appl. No.: 370,257

[22] Filed: Jan. 9, 1995

[30] Foreign Application Priority Data

Jan. 10, 1994 [JP] Japan ..... 6-000911

[51] Int. Cl.$^6$ ..... G03C 1/46

[52] U.S. Cl. ..... 430/503; 430/567; 430/600; 430/613; 430/614; 430/615; 430/599; 430/623; 430/626

[58] Field of Search ..... 430/567, 569, 430/503, 526, 623, 613, 614, 615, 599, 600

[56] References Cited

U.S. PATENT DOCUMENTS

| | | | |
|---|---|---|---|
| 3,905,821 | 9/1975 | Ohtani et al. | 430/600 |
| 3,960,568 | 6/1976 | Sueyoshi et al. | 430/630 |
| 4,054,458 | 10/1977 | Ohtani et al. | 430/600 |
| 4,680,257 | 7/1987 | Sato et al. | 430/614 |
| 4,806,461 | 2/1989 | Ikeda et al. | 430/567 |
| 4,956,269 | 9/1990 | Ikeda et al. | 430/505 |
| 5,068,173 | 11/1991 | Takehara et al. | 430/567 |
| 5,238,796 | 8/1993 | Maruyama et al. | 430/567 |
| 5,370,984 | 12/1994 | Takada et al. | 430/567 |
| 5,399,471 | 3/1995 | Murai | 430/567 |
| 5,418,124 | 5/1995 | Suga et al. | 430/567 |

FOREIGN PATENT DOCUMENTS

| | | |
|---|---|---|
| 59-97134 | 6/1984 | Japan . |
| 1319030 | 12/1989 | Japan . |

*Primary Examiner*—Geraldine Letscher
*Attorney, Agent, or Firm*—Sughrue, Mion, Zinn, Macpeak & Seas

[57] ABSTRACT

A silver halide color photographic material comprising a support having thereon at least one blue-sensitive silver halide emulsion layer, at least one green-sensitive silver halide emulsion layer and at least one red-sensitive silver halide emulsion layer, in which the silver halide color photographic material comprises at least one compound selected from the group consisting of the compounds represented by one of formulas (A-I) to (A-V); and 60% or more of the total projected area of silver halide grains contained in at least one of the light-sensitive silver halide emulsion layers is occupied by tabular grains having an aspect ratio of 2 or more, and the tabular grains have a dislocation line number of 10 or more per one grain.

24 Claims, No Drawings

SILVER HALIDE COLOR PHOTOGRAPHIC MATERIAL

FIELD OF THE INVENTION

The present invention relates to a silver halide color photographic material, and more particularly to a silver halide color photographic material which has high sensitivity and excellent pressure durability.

BACKGROUND OF THE INVENTION

Silver halide color photographic materials, particularly photographic materials for photographing, are desired to have high sensitivity, and in addition, the pressure durability is also required, because they are subjected to various types of pressure (for example, pressure is sometimes applied to a negative film for use in general photographing by winding in a patrone or frame feed when loaded in a camera).

A means for improving the sensitivity and the pressure durability by using tabular grains having an aspect ratio of 2 or more together with a specified sensitizing dye is described in JP-A-5-150390 (the term "JP-A" as used herein means an "unexamined published Japanese patent application"). However, although this enhances the sensitivity to some extent, the level of improvement in the pressure durability is low, and therefore a further improvement in the pressure durability has been particularly desired. Further, long-term storage of the photographic materials brings about the problem of increasing fogging. In order to improve storability of latent images, for example, JP-A-59-162546 (corresponding to U.S. Pat. No. 4,680,257) discloses to use a triazine compound together with a hardener containing an active vinyl group, and JP-A-59-97134 discloses to use a triazine compound with tabular silver halide grains, respectively. However, an improvement in sensitivity has been required. The above-described specifications fail to give a description or even a suggestion that the use of the triazine compound introduces an improvement in the pressure durability.

When some of photographic materials having a magnetic recording layer are stored in a film cartridge, a problem in fogging due to long-term storage becomes more severe.

SUMMARY OF THE INVENTION

An object of the present invention is to provide silver halide color photographic materials which are high in sensitivity and excellent in pressure durability, and in addition, can reduce an increase in fogging due to long-term storage.

DETAILED DESCRIPTION OF THE INVENTION

As a result of intensive studies, the present inventors have attained the above-mentioned object according to a silver halide color photographic material described below.

The present invention provides a silver halide color photographic material having a support and at least one blue-sensitive silver halide emulsion layer, at least one green-sensitive silver halide emulsion layer and at least one red-sensitive halide emulsion layer formed thereon, wherein the silver halide color photographic material comprises at least one compound represented by formulae (A-I) to (A-V), 60% or more of the total projected area of silver halide grains contained in at least one of the light-sensitive silver halide emulsion layers is occupied by tabular grains having an aspect ratio of 2 or more, and the tabular grains have a dislocation line number of 10 or more per one grain:

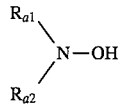
(A-I)

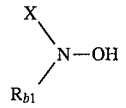
(A-II)

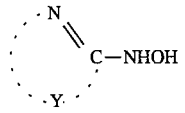
(A-III)

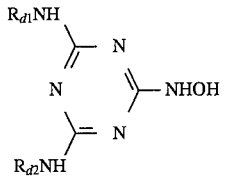
(A-IV)

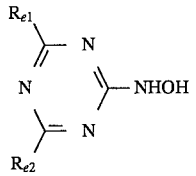
(A-V)

wherein in formula (A-I), $R_{a1}$ represents an alkyl group, an alkenyl group, an aryl group, an acyl group, an alkyl- or aryl-sulfonyl group, an alkyl- or aryl-sulfinyl group, a carbamoyl group, a sulfamoyl group, an alkoxycarbonyl group or an aryloxycarbonyl group, $R_{a2}$ represents a hydrogen atom or a group described for $R_{a1}$, with the proviso that when $R_{a1}$ is an alkyl group, an alkenyl group or an aryl group, $R_{a2}$ is an acyl group, an alkyl- or aryl-sulfonyl group, an alkyl- or aryl-sulfinyl group, a carbamoyl group, a sulfamoyl group, an alkoxycarbonyl group or an aryloxycarbonyl group, and $R_{a1}$ and $R_{a2}$ may combine with each other to form a 5-, 6- or 7-membered ring;

in formula (A-II), X represents a heterocyclic group, $R_{b1}$ represents an alkyl group, an alkenyl group or an aryl group, and X and $R_{b1}$ may combine with each other to form a 5-, 6- or 7-membered ring;

in formula (A-III), Y represents a nonmetallic atomic group necessary for forming a five-membered ring together with —N=C—, or a nonmetallic atomic group necessary for forming a 6-membered ring together with —N=C— provided that the end group of Y, bonded to the carbon atom of the —N=C— group, is a group selected from —N($R_{c1}$)—, —C($R_{c2}$)($R_{c3}$)—, —C($R_{c4}$)=, —O— and —S— (bonded to the carbon atom of —N=C— at the left side bond of each group) and $R_{c1}$, $R_{c2}$, $R_{c3}$ and $R_{c4}$ each represents a hydrogen atom or a substituent;

in formula (A-IV), $R_{d1}$ and $R_{d2}$, which may be the same or different, each represents an alkyl group or an aryl group, with the proviso that when $R_{d1}$ and $R_{d2}$ represent an unsubstituted alkyl group at the same time and $R_{d1}$ and $R_{d2}$ are the same group, $R_{d1}$ and $R_{d2}$ each is an alkyl group having 8 or more carbon atoms;

in formula (A-V), $R_{e1}$ and $R_{e2}$, which may be the same or different, each represents a hydroxylamino group, a hydroxyl group, an amino group, an alkylamino group, an arylamino group, an alkoxy group, an aryloxy group, an alkylthio group, an arylthio group, an alkyl group or an aryl group, with the proviso that $R_{e1}$ and $R_{e2}$ are not —$NHR_{e3}$ (wherein $R_{e3}$ represents an alkyl group or an aryl group) at the same time; and the compounds represented by formulae (A-I) to (A-V) may form bis-compounds.

The present inventors have found that oxygen is one of factors for causing fluctuation in photographic properties during storage of a photographic material or after photographing until development of the photographic material.

It is assumed that some compounds in the photographic material react with oxygen to affect the photographic properties and the compound represented by formula (A-I), (A-II), (A-III), (A-IV) or (A-V) captures them.

With the increase of gelatin coverage, the photographic properties may fluctuate greatly. This is presumed because a trace amount of impurities in gelatin react with oxygen to affect the photographic material.

It is also found that by using the compound represented by formula (A-I), (A-II), (A-III), (A-IV) or (A-V), the pressure durability can be improved.

The present invention will be described below in greater detail.

The compounds represented by formulae (A-I), (A-II), (A-III), (A-IV) and (A-V) will be described in greater detail.

In the present invention, an alkyl moiety represents a straight chain, branched chain, and cyclic alkyl moieties; an acyl moiety represents an aliphatic-, aromatic- and heterocyclic-moieties; and an aryl moiety represents, for example, a phenyl and naphthyl moiety. These moieties may be further substituted. The carbon numbers of the groups described hereinafter include also those included in the substituent(s).

In formula (A-I), $R_{a1}$ represents an alkyl group (preferably an alkyl group having from 1 to 36 carbon atoms, e.g., methyl, ethyl, i-propyl, cyclopropyl, butyl, isobutyl, cyclohexyl, t-octyl, decyl, dodecyl, hexadecyl, benzyl), an alkenyl group (preferably an alkenyl group having from 2 to 36 carbon atoms, e.g., allyl, 2-butenyl, isopropenyl, oleyl, vinyl), an aryl group (preferably an aryl group having from 6 to 40 carbon atoms, e.g., phenyl, naphthyl), an acyl group (preferably an acyl group having from 2 to 36 carbon atoms, e.g., acetyl, benzoyl, pivaloyl, α-(2,4-di-tert-amylphenoxy-)butyryl, myristoyl, stearoyl, naphthoyl, m-pentadecylbenzoyl, isonicotinoyl), an alkyl- or aryl-sulfonyl group (preferably an alkyl- or aryl-sulfonyl group having from 1 to 36 carbon atoms, e.g., methanesulfonyl, octanesulfonyl, benzenesulfonyl, toluenesulfonyl), an alkyl- or aryl-sulfinyl group (preferably an alkyl- or aryl-sulfinyl group having from 1 to 40 carbon atoms, e.g., methanesulfinyl, benzenesulfinyl), a carbamoyl group (inclusive of an N-substituted carbamoyl group and preferably a carbamoyl group having from 1 to 40 carbon atoms, e.g., N-ethylcarbamoyl, N-phenylcarbamoyl, N,N-dimethylcarbamoyl, N-butyl-N-phenylcarbamoyl), a sulfamoyl group (inclusive of an N-substituted sulfamoyl group and preferably a sulfamoyl group having from 0 to 40 carbon atoms, e.g., sulfamoyl, N-methylsulfamoyl, N,N-diethylsulfamoyl, N-phenylsulfamoyl, N-cyclohexyl-N-phenylsulfamoyl, N-ethyl-N-dodecylsulfamoyl), an alkoxycarbonyl group (preferably an alkoxycarbonyl group having from 2 to 36 carbon atoms, e.g., methoxycarbonyl, cyclohexyloxycarbonyl, benzyloxycarbonyl, isoamyloxycarbonyl, hexadecyloxycarbonyl), or an aryloxycarbonyl group (preferably an aryloxycarbonyl group having from 7 to 40 carbon atoms, e.g., phenoxycarbonyl, naphthoxycarbonyl). $R_{a2}$ represents a hydrogen atom or a group described for $R_{a1}$.

In formula (A-II), the heterocyclic group represented by X is a 5-, 6- or 7-membered heterocyclic ring which comprises at least one of a nitrogen atom, a sulfur atom, an oxygen atom and a phosphorus atom as a ring constituent atom, the bonding position (position of a monovalent group) of the heterocyclic ring is preferably a carbon atom, and the heterocyclic ring may be condensed with a benzene ring (e.g., 1,3,5-triazine-2-yl, 1,2,4-triazine-3-yl, pyridine-2-yl, pyrazinyl, pyrimidinyl, purinyl, quinolyl, imidazolyl, 1,2,4-triazole-3-yl, benzimidazole-2-yl, thienyl, furyl, imidazolidinyl, pyrrolinyl, tetrahydrofuryl, morpholinyl, phosphinoline-2-yl). The heterocyclic group preferably has from 0 to 36 carbon atoms. $R_{b1}$ represents an alkyl group, an alkenyl group or an aryl group in the same meaning as those described for $R_{a1}$ of formula (A-I).

In formula (A-III), Y represents a nonmetallic atomic group necessary for forming a 5-membered ring together with —N=C— (a ring group containing the nitrogen atom or further containing at least one of a nitrogen atom, an oxygen atom, a sulfur atom, and a phosphorus atom as a ring constituent, and the heterocyclic ring may be condensed with a benzene ring; for example, imidazolyl, benzimidazolyl, 1,3-thiazole-2-yl, 2-imidazoline-2-yl, purinyl or 3H-indole-2-yl). Y also represents a nonmetallic atomic group necessary for forming a 6-membered ring together with —N=C— and the end group of Y, bonded to the carbon atom of the —N=C group, is a group selected from —$N(R_{c1})$—, —$C(R_{c2})(R_{c3})$—, —$C(R_{c4})$=, —O— and —S— (bonded to the carbon atom of —N=C— at the left side bond of each group). The heterocyclic ring may be condensed with a benzene ring. $R_{c1}$, $R_{c2}$, $R_{c3}$ and $R_{c4}$, which may be the same or different, each represents a hydrogen atom or a substituent (e.g., an alkyl group, an alkenyl group, an aryl group, an alkoxy group, an aryloxy group, an alkylthio group, an arylthio group, an alkylamino group, an arylamino group, a halogen atom such as F, Cl, Br and I). Examples of the 6-membered ring group formed by Y include quinolyl, isoquinolyl, phthalazinyl, quinoxalinyl, 1,3,5-triazine-5-yl and 6H-1,2,5-thiadiazine-6-yl. The heterocyclic groups formed by Y preferably have from 1 to 36 carbon atoms.

In formula (A-IV), $R_{d1}$ and $R_{d2}$ each represents an alkyl group (preferably an alkyl group having from 1 to 36 carbon atoms, e.g., methyl, ethyl, i-propyl, cyclopropyl, n-butyl, isobutyl, hexyl, cyclohexyl, t-octyl, decyl, dodecyl, hexadecyl, benzyl) or an aryl group (preferably an aryl group having from 6 to 40 carbon atoms, e.g., phenyl, naphthyl). When $R_{d1}$ and $R_{d2}$ represent an unsubstituted alkyl group at the same time and $R_{d1}$ and $R_{d2}$ are the same group, $R_{d1}$ and $R_{d2}$ each is an alkyl group having 8 or more carbon atoms.

In formula (A-V), $R_{e1}$ and $R_{e2}$ each represents a hydroxylamino group, a hydroxyl group, an amino group, an alkylamino group (preferably an alkylamino group having from 1 to 50 carbon atoms, e.g., methylamino, ethylamino, diethylamino, methylethylamino, propylamino, dibutylamino, cyclohexylamino, t-octylamino, dodecylamino, hexadecylamino, benzylamino, benzylbutylamino), an arylamino group (preferably an arylamino group having from 6 to 50 carbon atoms, e.g., phenylamino, phenylmethylamino, diphenylamino, naphthylamino), an alkoxy group (preferably an alkoxy group having from 1 to 36 carbon atoms, e.g. methoxy, ethoxy, butoxy, t-butoxy, cyclohexyloxy, benzyloxy, octyloxy, tridecyloxy, hexadecyloxy), an aryloxy group (preferably an aryloxy group having from 6 to 40 carbon atoms, e.g., phenoxy, naphthoxy), an alkylthio group (preferably an alkylthio group having from 1 to 36 carbon atoms, e.g., methylthio, ethylthio, i-propylthio, butylthio, cyclohexylthio, benzylthio, t-octylthio, dodecylthio), an arylthio group (preferably an arylthio group having from 6 to 40 carbon atoms, e.g., phenylthio, naphthylthio), an alkyl group (preferably an alkyl group having from 1 to 36 carbon atoms, e.g., methyl, ethyl, propyl, butyl, cyclohexyl, i-amyl, sec-hexyl, t-octyl, dodecyl, hexadecyl), an aryl group (preferably an aryl group having from 6 to 40 carbon atoms, e.g., phenyl, naphthyl). However, $R_{e1}$ and $R_{e2}$ are not —$NHR_{e3}$ (wherein $R_{e3}$ is an alkyl group or an aryl group) at the same time.

$R_{a1}$ and $R_{a2}$ or X and $R_{b1}$ may combine with each other to form a 5-, 6- or 7-membered ring containing at least one nitrogen atom or further contaiining at least one of a nitrogen atom, an oxygen atom, a sulfur atom, and a phosphorus atom, and preferably having from 0 to 36 carbon atoms. The ring may be condensed with a benzene ring. Examples of the ring include a succinimido ring, a phthalimido ring, a triazole ring, a urazol ring, a hydantoin ring and 2-oxo-4-oxazolidinone ring.

Each group of the compounds represented by formulae (A-I), (A-II), (A-III), (A-IV) and (A-V) may be further substituted with at least one substituent.

Examples of the substituent include an alkyl group, an alkenyl group, an aryl group, a heterocyclic group (preferably 5- to 7-membered heterocyclic group containing at least one of a nitrogen atom, an oxygen atom, a sulphur atom, and a phosphorus atom as a hetero atom and containing 0 to 36 carbon atoms, furthermore the heterocyclic ring in the group may be condensed with a benzene ring), a hydroxy group, an alkoxy group, an aryloxy group, an alkylthio group, an arylthio group, an amino group, an acylamino group, a sulfonamido group ($RSO_2NH$—, wherein R represents alkyl or aryl), an alkylamino group, an arylamino group, a carbamoyl group, a sulfamoyl group, —$SO_3M$, —COOM (wherein M represents H, an alkali metal atom such as Li, Na and K, or $NH_4$), a halogen atom (e.g., F, Cl, Br and I), a cyano group, a nitro group, a sulfonyl group ($RSO_2$—, wherein R represents, for example, alkyl, aryl), an acyl group, an alkoxycarbonyl group, an aryloxycarbonyl group, an acyloxy group and a hydroxyamino group. These substituents may be further substituted with at least one of these substituents.

In formula (A-I), preferably $R_{a2}$ is a hydrogen atom, an alkyl group, an alkenyl group or an aryl group and $R_{a1}$ is an acyl group, a sulfonyl group, a sulfinyl group, a carbamoyl group, a sulfamoyl group, an alkoxycarbonyl group or an aryloxycarbonyl group, more preferably, $R_{a2}$ is an alkyl group or an alkenyl group and $R_{a1}$ is an acyl group, a sulfonyl group, a carbamoyl group, a sulfamoyl group, an alkoxycarbonyl group or an aryloxycarbonyl group, and most preferably, $R_{a2}$ is an alkyl group and $R_{a1}$ is an acyl group.

In formula (A-II), $R_{b1}$ is preferably an alkyl group or an alkenyl group, more preferably an alkyl group, and (A-II) is preferably the compound represented by the following formula (A-II-1) (preferably X in formula (A-II) is 1,3,5-triazine-2-yl), more preferably the compound is represented by the following formula (A-II-2).

(A-II-1)

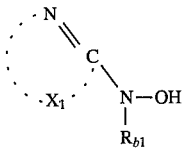

wherein $R_{b1}$ is the same as $R_{b1}$ of formula (A-II) and $X_1$ represents a nonmetallic atomic group necessary for forming a 5- or 6-membered ring with

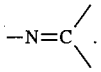

Among compounds represented by formula (A-II-1), more preferred are those where $X_1$ forms a 5- or 6-membered heterocyclic aromatic ring.

(A-II-2)

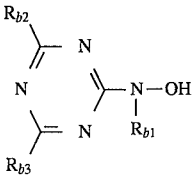

wherein $R_{b1}$ is the same as $R_{b1}$ of formula (A-II) and $R_{b2}$ and $R_{b3}$, which may be the same or different, each represents a hydrogen atom or a substituent. Examples of the substituent are the same as those disclosed hereinabove as examples for the substituent.

Among the compounds represented by formula (A-II-2), more preferred are those where $R_{b2}$ and $R_{b3}$ each is a hydroxyamino group, a hydroxyl group, an amino group, an alkylamino group, an arylamino group, an alkoxy group, an aryloxy group, an alkylthio group, an arylthio group, an alkyl group or an aryl group.

Among the compounds represented by formula (A-III), preferred are those where Y represents a nonmetallic atomic group necessary for forming a 5-membered ring, more preferred are those where the end atom of Y bonded to the carbon atom of the —N═C— group is a nitrogen atom and most preferred are those where Y forms an imidazoline ring. The imidazoline ring may be condensed with a benzene ring.

Among the compounds represented by formula (A-IV), preferred are those where $R_{d1}$ and $R_{d2}$ each is an alkyl group.

In formula (A-V), $R_{e1}$ and $R_{e2}$ each is preferably a group selected from a hydroxyamino group, an alkylamino group and an alkoxy group and, more preferably, $R_{e1}$ is a hydroxylamino group and $R_{e2}$ is an alkylamino group.

The compound represented by formulae (A-I) to (A-V) may be in a form of a bis-compound which is formed at $R_{a1}$, $R_{a2}$, X, $R_{b1}$, Y, $R_{d1}$, $R_{d2}$, $R_{e1}$ or $R_{e2}$.

Among the compounds represented by formulae (A-I) to (A-V), compounds having a total carbon number of 15 or less are preferred in view of their action also on the layer other than the layer containing the compounds, whereas compounds having a total carbon atom number of 16 or more are preferred for the purpose of providing effects only on the layer containing the compounds.

Among the compounds represented by formulae (A-I) to (A-V), preferred are those represented by formulae (A-I), (A-II), (A-IV) and (A-V), more preferred are those represented by formulae (A-I), (A-IV) and (A-V), and still more preferred are those represented by formulae (A-I) and (A-V).

Specific examples of the compounds represented by formulae (A-I) to (A-V) of the present invention are described below, but the present invention should not be construed as being limited thereto. In the present invention, the alkyl moiety in compounds which does not have i-, n- or t- indicates a n-alkyl moiety.

A-1
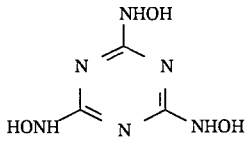
A-2
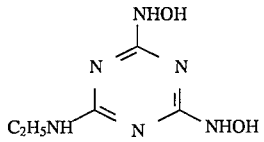
A-3
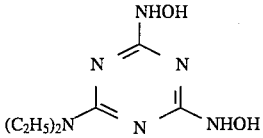
A-4
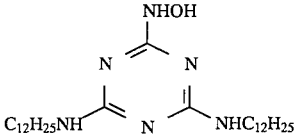
A-5
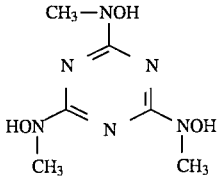
A-6
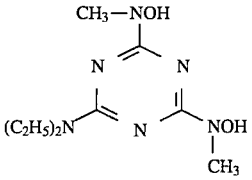
A-7
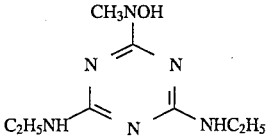
A-8
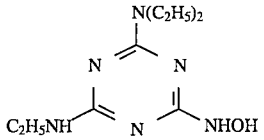
A-9
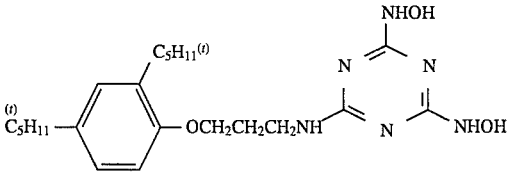
A-10
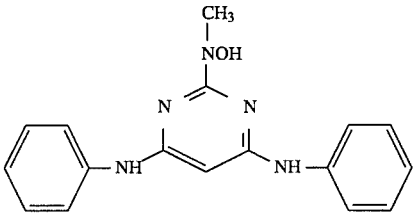
A-11
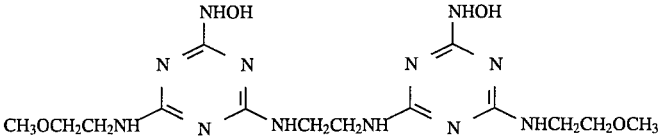
A-12
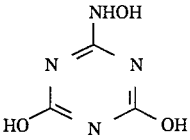
A-13
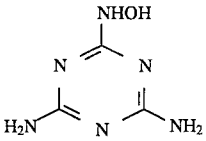
A-14
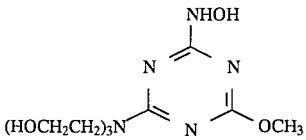
A-15
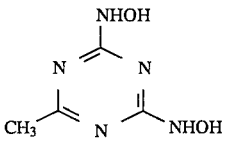
A-16
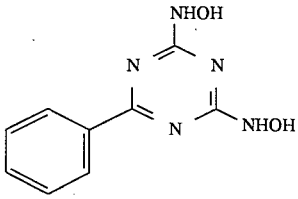
A-17
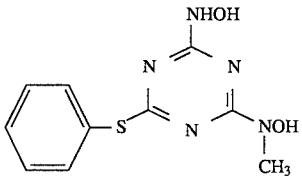

-continued
A-18
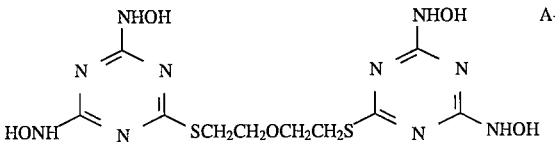
A-19
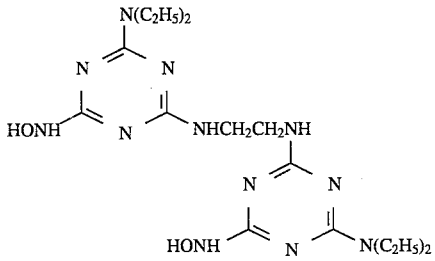
A-20
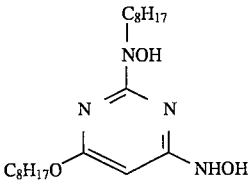
A-21
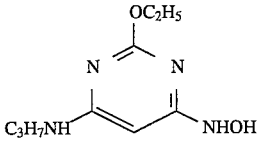
A-22
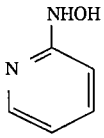
A-23
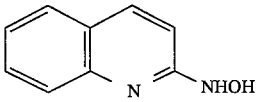
A-24
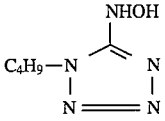
A-25
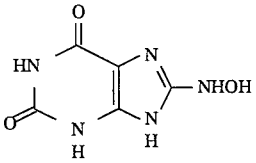
A-26
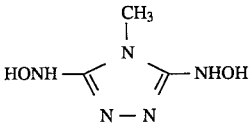
A-27
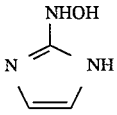
A-28
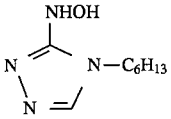
A-29
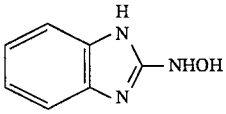
A-30
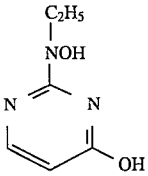
A-31
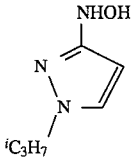
A-32
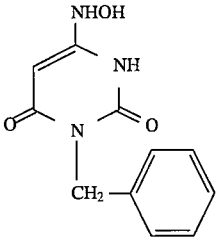
A-33
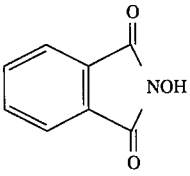
A-34
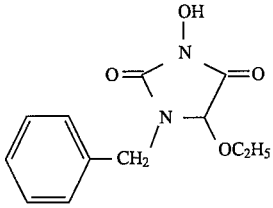
A-35
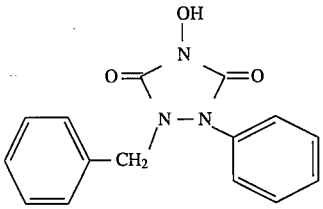

-continued

A-36

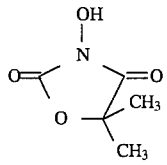

A-37

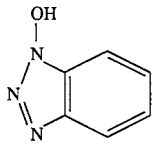

A-38

$CH_3C(=O)NOH$
$CH_3$

A-39

$C_{15}H_{31}C(=O)NOH$
$CH_3$

A-40

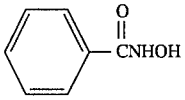

A-41

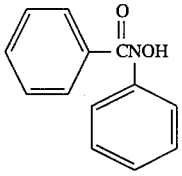

A-42

$C_8H_{17}NHC(=O)NHOH$

A-43

$C_{13}H_{27}C(=O)NHOH$

A-44

$C_2H_5OC(=O)NOH$

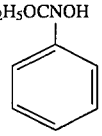

A-45

$(C_2H_5)_2NSO_2NHOH$

A-46

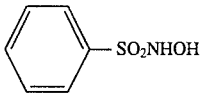

A-47

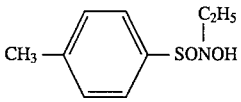

A-48

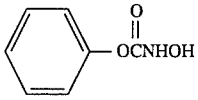

A-49

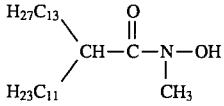

A-50

$(n)\ C_{14}H_{29}OC(=O)CH_2CH_2C(CH_3)=NOH$

A-51

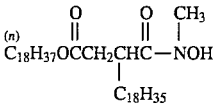

A-52

$(n)\ C_{18}H_{37}OC(=O)CH(C_{18}H_{35})CH_2C(OCH_3)=NOH$

A-53

$C_{16}H_{33}OC(=O)CH_2CH(C_{18}H_{37}{}^{(n)})C(OCH_3)=NOH$

A-54

$C_{16}H_{33}OC(=O)CH(C_{15}H_{29})CH_2C(OC_2H_5)=NOH$

A-55

$C_{18}H_{37}OC(=O)CH_2CH_2C(OCH_3)=NOH$

These compounds correspond to the above-described formulae (A-I) to (A-V) as follows.

Formula (A-I): A-33 to A-55

Formula (A-II): A-5 to A-7, A-10, A-20, A-30

Formula (A-III): A-21 to A-29, A-31, A-32

Formula (A-IV): A-8, A-11, A-19

Formula (A-V): A-1 to A-4, A-9, A-12 to A-18

These compounds of the present invention can be easily synthesized by or according to the methods described in *J. Org. Chem.*, 27, 4054('62), *J. Amer. Chem. Soc.*, 73, 2981('51) and JP-B-49-10692 (the term "JP-B" as used herein means an "examined Japanese patent publication").

In the present invention, the compound represented by formula (A-I), (A-II), (A-III), (A-IV) or (A-V) may be added by dissolving it in a water-soluble solvent such as water, methanol or ethanol or a mixed solvent of these or by emulsification dispersion or it may be previously added at the preparation of emulsion.

In the case of dissolution in water, if the solubility of the compound increases with an increased or reduced pH, the compound may be added by dissolving it at an increased or reduced pH.

In the present invention, the compounds represented by formulae (A-I) to (A-V) may be used in combination of two or more thereof.

For example, a combination use of a water-soluble compound and an oil-soluble compound is advantageous in view of photographic performance. In examples compounds A-1 to A8, A-11 to A-19, A-21 to A-34, A-36 to A-38, A-40, A-42, and A-44 to A-48 are water soluble and the other compounds are oil soluble.

The total amount of at least one compound represented by (A-I) to (A-V) in the photographic material is preferably from $10^{-4}$ mmol/m$^2$ to 10 mmol/m$^2$, and more preferably from $10^{-3}$ mmol/m$^2$ to 1 mmol/m$^2$. If the amount exceeds 10 mmol/m$^2$, undesired effects to photographic characteristics tends to occur.

The compound may be incorporated into any hydrophilic colloid layer in the photographic material, such as a silver halide light-sensitive layer and a light-insensitive layer, for example, an intermediate layer, a protective layer, an anti-halation layer, a filter layer, and an antiirradiation layer. It is preferred to incorporate the compound into a silver halide light-sensitive layer.

In the emulsions used in the present invention, at least 60% of the whole projected area of silver halide grains contained in at least one of sensitive silver halide emulsion layers is occupied by tabular grains having an aspect ratio of 2 or more, and the dislocation line number of the tabular grains is at least 10 per grain.

If the aspect ratio is less than 2, sensitivity of the photographic material tends to be lower, on the other hand, if the proportion of the tabular grains is less than 60%, the effects of the present invention tends to be insufficient.

Here, the term "tabular grain" is a generic name of a grain having either one twin plane, or 2 or more parallel twin planes. In the case that all ions existing in lattice points at the both sides of a (111) plane maintain the relation of mirror image, the (111) plane is called the twin plane. The tabular grains have a triangular shape, a hexagonal shape or a circular shape rounding them, when observed from above, and the tabular grains having a triangular shape, a hexagonal shape and a circular shape have triangular, hexagonal and circular outer surfaces parallel to each other, respectively.

In the present invention, the aspect ratio of the tabular grain is defined as the value of each grain diameter divided by its thickness for the tabular grain having a diameter of 0.1 μm or more. The thickness of the grain can be readily measured by depositing a metal over the grain together with a reference latex from an oblique direction of the grain, determining the length of a shadow on an electron microscopic photograph, and calculating the thickness of the grain based on the length of the shadow of the reference latex.

In the present invention, the diameter of the grain is a diameter of a circle having an area equal to the projected area of the parallel outer surface thereof.

The projected area of the grain is obtained by measuring the area on an electron microscopic photograph and correcting the projection magnification.

The diameter of the tabular grains is preferably from 0.15 to 5.0 μm. The thickness of the tabular grains is preferably from 0.05 to 1.0 μm.

In the emulsions used in the present invention, 60% or more of the whole projected area of the silver halide grains is preferably occupied by the tabular grains having an aspect ratio of 3 or more, and more preferably by the tabular grains having an aspect ratio of 5 or more from the point of view, for example, in sensitivity and graininess.

The ratio occupied by the tabular grains is preferably 70% or more, and particularly preferably 80% or more of the whole projected area.

Further, the use of monodisperse tabular grains may occasionally offer a preferable result. The structure and the preparation of the monodisperse tabular grains are described in, for example, JP-A-63-151618, etc. (corresponding to U.S. Pat. No. 4,797,354). Briefly describing the shape thereof, 70% or more of the whole projected area of the silver halide grains is occupied by tabular silver halide grains having a hexagonal shape in which a ratio of the length of the longest side to that of the shortest side is 2 or less and, in addition, having two parallel outer surfaces, and further, the tabular grains have a monodispersity of 20% or less in the coefficient of variation of the grain size distribution of the hexagonal tabular silver halide grains (a value of a variation (standard deviation) of grain sizes represented by circle-corresponding diameters of the projected areas divided by an average grain size).

Further, the emulsions used in the present invention contain dislocation lines. Dislocation of tabular grains can be observed by a direct method using a transmission electron microscope at a low temperature as described in, for example, J. F. Hamilton, *Phot. Sci. Eng.*, 11, 57 (1967) and T. Shiozawa, *J. Soc. Phot. Sci. Japan*, 35, 213 (1972). That is, silver halide grains are taken out of an emulsion with caution so as not to occur dislocation by applying pressure thereto, placed on a mesh for electron microscopic observation and observed by the transmission method under a condition where the sample is cooled to prevent damage (such as printout) due to an electron radiation. Then, as thicker grains make it more difficult to transmit an electron radiation, the use of a high voltage type electron microscope (200 KV or more to the grain having a thickness of 0.25 μm) enables clearer observation of dislocation lines. From the photograph of the grains obtained by such a method, the position and the number of dislocation lines can be determined for the respective grains when observed from the vertical direction to the principal plane.

In the present invention, it is preferred that 60% or more of the silver halide grains in number contain about 10 dislocation lines per grain. Sixty per cent or more, preferably 80% or more (most preferably 100%) of the grains in number are occupied by grains preferably containing 10 dislocation lines, more preferably containing 20 dislocation lines, and further more preferably containing 30 dislocation lines, per grains. When the dislocation lines exist crowdedly, or when the dislocation lines intersecting one another are observed, the number of the dislocation lines per grain can not be counted clearly in some cases. However, also in these cases, it is possible to count the dislocation lines by about 10 lines, about 20 lines or about 30 lines.

The dislocation line can be introduced into, for example, the vicinity of the periphery of a tabular grain. In this case, the dislocation line is almost vertical to the periphery and develops so as to run from the point of x% of a length of the distance from the center to the side (periphery) of the tabular grain up to the periphery. The value of x is preferably from 10 to less than 100, more preferably from 30 to less than 99, and most preferably from 50 to less than 98. Then, the shape formed by connecting the starting points of dislocation is almost similar to the shape of the grain. However, it is not completely similar thereto, and sometimes distorted. The dislocation of this type is not observed in the central region of the grain. The direction of the dislocation lines is crystallographically almost that of (211), but the dislocation lines meander or intersect one another in some cases.

The tabular grain may have the dislocation lines formed almost uniformly over the whole region of the periphery thereof, or may have the dislocation lines formed in a local area of the periphery. For example, in a hexagonal tabular silver halide grain, the dislocation lines may limitedly exist in the vicinities of 6 vertexes thereof, or may limitedly exist in the vicinity of one vertex thereof. On the other hand, it is also possible for the dislocation lines to limitedly exist only on the sides except the vicinities of 6 vertexes thereof.

Further, the dislocation lines may be formed over the regions including the centers of two parallel principal planes of the tabular grain. When the dislocation lines are formed over the whole area of the principal plane, the direction thereof is sometimes crystallographically almost the direction of (211) on observing them from the vertical direction to the principal plane, but is occasionally the direction of (110). In some cases, the dislocation lines are formed at random. Further, the dislocation lines themselves and the length thereof may also be random. In some cases, short lines are observed on the principal plane, and in other cases, long lines reaching the side (periphery) are observed. The dislocation lines are linear in some instances, or often meander in other instances. Further, in many cases, they intersect one another.

The dislocation lines may limitedly exists in the periphery, on the principal plane or in local regions as described above, or may be formed in combined portions thereof. That is, the dislocation lines may simultaneously exist both in the periphery and on the principal plane.

The introduction of the dislocation lines into the periphery of the tabular grain can be achieved by providing a specific high silver iodide layer inside the grain. Here, the high silver iodide layer includes the case that a high silver iodide region is discontinuously formed. Specifically, after preparation of a substrate grain, the high silver iodide layer is provided thereon, followed by covering the outside thereof with a layer having a lower content of silver iodide than the high silver iodide layer. The content of silver iodide in the tabular substrate grain, which is lower than the high silver iodide layer is preferably from 0 to 20 mole %, and more preferably from 0 to 15 mole %.

The high silver iodide layer contained inside the grain is a silver halide solid solution containing silver iodide. In this case, preferred examples of the silver halides include silver iodide, silver iodobromide and silver chloroiodobromide, and silver iodide or silver iodobromide (the content of silver iodide: 10 to 40 mole %) is more preferred. In order to allow the high silver iodide layer inside the grain (hereinafter referred to as the "internal high silver iodide layer") to selectively exist either on the sides or on the vertexes of the substrate grain, control can be conducted by forming conditions of the substrate grain and forming conditions of the internal high silver iodide layer. Important factors for the forming conditions of the substrate grain are the pAg (the logarithm of the reciprocal of a silver ion concentration); the presence or absence, the kind and the amount of a solvent for silver halides; and the temperature. When the growth of the substrate grain is conducted at pAg 8.5 or less, and more preferably at pAg 8 or less, it is possible to form the internal high silver iodide layer in the vicinities of vertexes of the substrate grain selectively. On the other hand, when the growth of the substrate grain is performed at pAg 8.5 or more, and more preferably at pAg 9 or more, it is possible to form the internal high silver iodide layer on the sides of the substrate grain.

The tabular grains of the present invention can be readily prepared according to methods as described in Cleve, *Photography Theory and Practice*, p 131 (1930), Gutoff, *Photographic Science and Engineering, Vol.* 14, pp 248–257 (1970), U.S. Pat. Nos. 4,434,226, 4,414,310, 4,433,048, 4,439,520, British Patent 2,112,157, etc.

The silver halide photographic material of the present invention may have a magnetic recording layer comprising ferromagnetic powder provided on the opposite side to the light-sensitive emulsion layer with the intervention of the support therebetween.

The magnetic layer used in the present invention may be a transparent magnetic layer as disclosed in JP-A-53-109604, JP-B-57-6576, JP-A-60-45248, U.S. Pat. No. 4,947,196, and International Patents W090/04254, 91/11750, 91/11816, 92/08165 and 92/08227 or a stripe-like magnetic layer as disclosed in JP-A-4-124642 and JP-A-4-124645. In the present invention, a transparent magnetic layer is preferred.

In the case where the magnetic layer is a transparent layer, the optical density is preferably 1.0 or less, more preferably 0.75 or less, most preferably from 0.02 to 0.30.

The magnetic layer comprises a binder having dispersed therein ferromagnetic powder.

The coating amount of the magnetic powder is preferably from 5 mg to 3 g, more preferably from 10 mg to 2 g, most preferably from 20 mg to 100 mg, per $m^2$ of the silver halide color photographic material.

Examples of the above-described ferromagnetic powder include $\gamma$-$Fe_2O_3$ powder, Co-doped $\gamma$-$Fe_2O_3$ powder, Co-doped $Fe_3O_4$ powder, Co-doped FeOx ($4/3<x<3/2$) powder, other Co-containing iron oxides and other ferrites such as a hexagonal ferrite, e.g., M- or W-type hexagonal Ba ferrite, Sr ferrite, lead ferrite, Ca ferrite or a solid solution or ion substitution product thereof.

The hexagonal ferrite magnetic powder uses elements in which Fe atoms as a constituent element of a uniaxial isotropic hexagonal ferrite crystal thereof are partly substituted by a divalent metal, at least one pentavalent metal selected from Nb, $Sb_4$ and Ta, and from 0.05 to 0.5 atoms of Sn per one composite formula, and the elements each has a coercive force of from 200 to 2,000.

The divalent metal used for the hexagonal ferrite is preferably an element relatively habitudinal to substitute Fe atoms in the ferrite, such as Mn, Cu or Mg.

In the hexagonal ferrite, the optimum substitution amount of the divalent metal (MII) and the pentavalent metal (MV) varies depending upon the combination of MII and MV but it is preferably on the order of from 0.5 to 1.2 elements per one composite formula of MII.

In order to describe the relation in the substitution amounts of substituted elements, let be an example a magneto-plumbite type Ba ferrite of which substituted product is represented by the composite formula:

$$BaFe_{12-(x+y+z)}MII_xMV_ySn_zO_{19}$$

wherein x, y or z represents the substitution amount of MII, MV or Sn element per one composite formula of ferrite, respectively. Since MII, MV and Sn are divalent, pentavalent and tetravalent, respectively, and Fe element substituted is trivalent, under consideration of valence number compensation, the relation will be held as $y=(x-z)/2$. Namely, the substitution amount of MV is univocally determined by the substitution amount of MII and the substitution amount of Sn.

The above-described ferromagnetic powder usually has a coercive force (Hc) of 200 Oe or more, preferably 300 Oe or more.

The magnetic powder has a size in the length direction of preferably 0.3 μm or less, more preferably 0.2 μm or less.

The ferromagnetic powder has a specific surface area according to BET method usually of 20 $m^2/g$ or more, preferably from 25 to 80 $m^2/g$.

The shape of the above-described ferromagnetic powder is not particularly restricted and may be any of needle-like, spherical or ellipsoidal.

The magnetic layer of the present invention may contain a fatty acid.

The above-described fatty acid may be either monobasic or dibasic but the fatty acid of the present invention preferably has from 6 to 30 carbon atoms, more preferably from 12 to 22 carbon atoms.

Preferred examples of the fatty acid include a caproic acid, a caprylic acid, a capric acid, a lauric acid, a myristic acid, a palmitic acid, a stearic acid, an isostearic acid, a linolenic acid, a linoleic acid, an oleic acid, an elaidic acid, a behenic acid, a malonic acid, a succinic acid, a maleic acid, a glutaric acid, an adipic acid, a pimelic acid, an azelaic acid, a sebacic acid, a 1,12-dodecanedicarboxylic acid and an octanedicarboxylic acid.

Among these, particularly preferred are a myristic acid, an oleic acid and a stearic acid.

Further, by incorporating a fatty acid ester into the magnetic layer, the abrasion coefficient of the magnetic layer is reduced and thereby the running property and durability of the magnetic recording medium of the present invention is further improved.

Examples of the above-described fatty acid ester include oleyl oleate, oleyl stearate, isocetyl stearate, dioleyl maleate, butyl stearate, butyl palmitate, butyl myristate, octyl myristate, octyl palmitate, amyl stearate, amyl palmitate, stearyl stearate, lauryl oleate, octyl oleate, isobutyl oleate, ethyl oleate, isotridecyl oleate, 2-ethylhexyl stearate, 2-ethylhexyl myristate, ethyl stearate, 2-ethylhexyl palmitate, isopropyl palmitate, isopropyl myristate, butyl laurate, cetyl-2-ethyl hexalate, dioleyl adipate, diethyl adipate, diisobutyl adipate and diisodecyl adipate.

Among these, particularly preferred are butyl stearate and butyl palmitate.

The above-described various fatty acid esters may be used individually or in combination of two or more thereof.

The magnetic layer of the present invention may further contain a lubricant other than the above-described fatty acid or fatty acid ester in combination therewith.

Examples of other lubricants include a silicone lubricant, a fatty acid-modified silicone lubricant, a fluorine-containing lubricant, a liquid paraffin, squalane and carbon black. These may be used individually or in combination of two or more thereof.

The binder used is a transparent binder such as cellulose ester or gelatin.

A dispersion solution of magnetic particles may be prepared in a solution of a transparent binder such as cellulose ester or gelatin using a solvent for the above-described binder such as an organic solvent for cellulose ester or water for gelatin.

Examples of the organic solvent used in the dispersion, kneading or coating of particles include ketones such as acetone, methyl ethyl ketone, methyl isobutyl ketone, cyclohexanone, isophoron and tetrahydrofuran; alcohols such as methanol, ethanol, propanol, butanol, isobutyl alcohol, isopropyl alcohol and methylcyclohexanol; esters such as methyl acetate, ethyl acetate, butyl acetate, isobutyl acetate, isopropyl acetate, ethyl lactate and glycol acetate monoethyl ether; ethers such as diethyl ether, tetrahydrofuran, glycol dimethyl ether, glycol monoethyl ether and dioxane; tar (aromatic hydrocarbon) such as benzene, toluene, xylene, cresol, chlorobenzene and styrene; chlorinated hydrocarbons such as methylene chloride, ethylene chloride, carbon tetrachloride, chloroform, ethylene chlorohydrin and dichlorobenzene; N,N-dimethylformaldehyde and hexane, and these may be used in a freely selected proportion.

The kneading method is not particularly restricted and the addition order of respective ingredients may be appropriately selected.

The magnetic coating solution may be prepared by means of a commonly used kneader, for example, two-roll mill, three-roll mill, ball mill, pebble mill, thoron mill, sand grinder, Szegvari, attritor, high-speed impeller disperser, high-speed stone mill, high-speed impact mill, disper, kneader, high-speed mixer, ribbon blender, co-kneader, intensive mixer, tumbler, blender, disperser, homogenizer, single axis screw extruder, biaxial screw extruder or ultrasonic disperser. With respect to kneading and dispersion, techniques are described in detail in T. C. PATTON, *Paint Flow and Pigment Dispersion*, published by John Wiley & Sons (1964), Shin-ichi Tanaka, *Kogyo Zairyo*, Vol. 25, 37 (1977) and references cited in the above-described literatures. The solution is delivered and coated in a continuous processing by means of an appropriate combination of these kneaders and dispersers. Further, U.S. Pat. Nos. 2,581,441 and 2,855,156 describe thereon. The magnetic coating solution of the present invention may also be prepared by conducting kneading and dispersion according to the methods described in the above-described literatures or references cited therein.

In advance of coating, the support may be subjected to corona discharge treatment, plasma treatment, undercoating treatment, heat treatment, dust removal treatment, metal deposition treatment or alkali treatment. Disclosures on the support are seen, for example, in West German Patent 3,338,854A, JP-A-59-116926, U.S. Pat. No. 4,388,368 and Yukio Mitsuishi, *Sen'i to Kogyo*, Vol. 31, pp. 50–55 (1975).

Preferred embodiments of the support having thereon the magnetic particle layer used in the present invention are described below.

The support is preferably composed of a natural or synthetic polymer and preferred examples thereof include cellulose ester, polyester, polycarbonate, polyethylene phthalate, polyethylene naphthalate and polyparaphenylene terephthalamide with cellulose acetate ester, polycarbonate and polyethylene terephthalate being more preferred.

For localizing particles at one surface side of the support, a method comprising casting a dope containing a support polymer and magnetic particles and then localizing magnetic particles at one surface side of the support by gravity, magnetic force or the like or, as described in JP-B-30-986 and WO91/11750, a method comprising casting simultaneously a dope containing magnetic particles and a dope free therefrom to localize the particles at one surface side of the support may be used, but the latter method is preferred because a high-speed production can be conducted.

The photographic light-sensitive material of the present invention may have at least one light-sensitive silver halide emulsion layer formed on a support. A typical example is a silver halide photographic material having on a support at least one sensitive layer composed of plural silver halide emulsion layers each having a substantially same color sensitivity but having a different light sensitivity. The light-sensitive layer is a unit light-sensitive layer having a color sensitivity to one of a blue light, a green light, and a red light, and in a multilayer silver halide color photographic material, unit light-sensitive layers are generally disposed in the order of a red-sensitive emulsion layer, a green-sensitive emulsion layer, and a blue-sensitive emulsion layer from the support side. However, according to the purpose, the foregoing disposition order of the unit light-sensitive layers may be reversed or the disposition order that a different light-sensitive emulsion layer is disposed between the light-sensitive emulsion layers each having a same color sensitivity can be employed. Also, a light-insensitive layer may be formed between the foregoing light-sensitive layers, on the uppermost layer, and/or under the lowermost layer.

These layers described above may contain couplers described below, DIR compounds, color mixing inhibitors, etc.

As plural silver halide emulsion layers constituting each unit light-sensitive layer, it is preferred that two layers of a high-speed emulsion layer and a low-speed emulsion layer are disposed in such a manner that the light-sensitivity of them becomes successively lower towards the support as described in German Patent 1,121,470 or British Patent 923,045. Also, a low-speed emulsion layer may be disposed at the side farther from the support and a high-speed emulsion layer may be disposed at the side near the support as described in JP-A-57-112751, JP-A-62-200350, JP-A-62-206541, and JP-A-62-206543.

In practical examples, the silver halide emulsion layers can be disposed on the support in the order of a low-speed blue-sensitive emulsion layer (BL)/a high-speed blue-sensitive (BH)/a high-speed green-sensitive emulsion layer (GH)/a low-speed green-sensitive emulsion layer (GL)/a high-speed red-sensitive emulsion layer (RH)/a low-speed red-sensitive emulsion layer (RL), in the order of BH/BL/GL/GH/RH/RL, or in the order of BH/BL/GH/GL/RL/RH.

Also, they can be disposed in the order of a blue-sensitive emulsion layer/GH/RH/GL/RL from the farthest side of the support as described in JP-B-55-34932. Furthermore, they can also be disposed in the order of a blue-sensitive emulsion layer/GL/RL/GH/RH from the farthest side of the support as described in JP-A-56-25738 and JP-A-62-63936.

Also, a three-layer structure composed of a light-sensitive silver halide emulsion layer having the highest light sensitivity as the upper layer, a light-sensitive silver halide emulsion layer having a lower light sensitivity than the upper layer as an inter layer, and a silver halide emulsion layer having a far lower light sensitivity than the inter layer as the lower layer, i.e., the light sensitivity is successively lowered towards the support as described in JP-B-49-15495 can be used. Even in the case composed of three layers each having a different light sensitivity, the layers may be disposed in the order of the medium-speed emulsion layer/the high-speed emulsion layer/the low-speed emulsion layer from the farthest side from the support in a same color-sensitive layers as described in JP-A-59-202464.

In other examples, the light-sensitive emulsion layers may be disposed in the order of the high-speed emulsion layer/the low-speed emulsion layer/the medium-speed emulsion layer or in the order of the low-speed emulsion layer/the medium-speed emulsion layer/the high-speed emulsion layer. Also, when the unit light-sensitive layer is composed of four or more layers, the disposition of these layers may be changed as described above.

For improving the color reproducibility, it is preferred to dispose a donor layer (CL) of an interlayer effect having a different spectral sensitivity distribution from the main light-sensitive layer such as BL, GL, RL, etc., adjacent to or near the main light-sensitive layer as described in U.S. Pat. Nos. 4,663,271, 4,705,744, and 4,707,436, JP-A-62-160448, and JP-A-63-89850.

The silver halide which is preferably used in the present invention is silver iodobromide, silver iodochloride, or silver iodochlorobromide each containing not more than about 30 mole % silver iodide. Silver iodobromide or silver iodochlorobromide containing from about 2 mole % to about 10 mole % silver iodide is particularly preferred.

The silver halide grains in the photographic silver halide emulsion being used in this invention may have a regular crystal form such as cubic, octahedral, tetradecahedral, etc., an irregular crystal form such as spherical, tabular, etc., a crystal form having a crystal defect such as twin planes, or a composite form of them.

The grain sizes of the silver halide may be fine grains having not larger than about 0.2 μm or large size grains having a projected area diameter of up to about 10 μm. Also, the silver halide emulsion may be a polydisperse emulsion or a monodisperse emulsion.

The silver halide photographic emulsions being used in the present invention can be prepared using the methods described, e.g., in *Research Disclosure* (hereinafter, is referred to as RD), No. 17643 (December, 1978) pages 22 to 23, "I. Emulsion Preparation and Types"; RD, No. 18716 (November, 1979), page 648; RD, No. 307105 (November, 1989), pages 863 to 865; P. Glafkides, *Chemie et Phosique Photographique*, Paul Montel, 1967; G. F. Duffin, *Photographic Emulsion Chemistry*, Focal Press, 1966; and V. L. Zelikman et al., *Making and Coating Photographic Emulsion*, Focal Press, 1964.

The monodisperse emulsions described in U.S. Pat. Nos. 3,574,628 and 3,655,394 and British Patent 1,413,748 can be preferably used in this invention.

Also, tabular silver halide grains having an aspect ratio of at least about 3 can be used in the present invention.

The tabular silver halide grains can be easily prepared by the methods described in Gutoff, *Photographic Science and Engineering*, Vol. 14, pages. 248 to 257 (1970); U.S. Pat. Nos. 4,434,226, 4,414,310, 4,433,048, and 4,439,520 and British Patent 2,112,157.

The crystal structure may be uniform throughout the crystal grain or may be composed of a different halogen composition between the inside and the outer side portion, or may have a layer structure. Also, a silver halide having a different composition may be junctioned by an epitaxial junction or a compound other than a silver halide, such as silver rhodanate, lead oxide, etc., be junctioned. Also, a mixture of silver halide grains having various crystal forms may be used.

The silver halide emulsion being used invention may be of a surface latent image type of forming latent images mainly on the surfaces thereof, of an inside latent image type of forming latent images in the inside thereof, or of a type of forming latent images on the surface and in the inside but it is necessary that the silver halide emulsion is a negative working emulsion.

The core/shell type inside latent image type emulsion described in JP-A-63-264740 may be also used and the method of preparing the emulsion is described in JP-A-59-133542. The thickness of the shell of the core/shell type emulsion differs depending on the type of development processing, etc., but is preferably from 3 nm to 40 nm, and particularly preferably from 5 nm to 20 nm.

The silver halide emulsion which is usually physically ripened, chemically ripened, and spectrally sensitized is used. The additives which are used in these steps are described in RD, No. 17643, RD, No. 18716, and RD, No. 307105 and the corresponding portions are summarized in a table shown below.

In the photographic light-sensitive material of the present invention, 2 or more kinds of silver halide emulsions having at least one different character in the grain sizes, the grain size distribution, the halogen composition, the form of the grains, and the sensitivity of the light-sensitive silver halide emulsions can be used in a same emulsion layer as a mixture thereof.

It is preferred to apply the silver halide grains having fogged grain surfaces described in U.S. Pat. No. 4,082,553, the silver halide grains having the fogged grain inside described in U.S. Pat. No. 4,626,498 and JP-A-59-214852, or colloid silver to the light-sensitive silver halide emulsion layer(s) and/or the substantially light-insensitive hydrophilic colloid layer(s).

The silver halide grains having the fogged grain inside or the fogged surface mean silver halide grains which can be uniformly developed (non-imagewise) regardless of the unexposed portions and the exposed portions of the photographic light-sensitive material and the preparation method thereof are described in U.S. Pat. No. 4,626,498 and JP-A-59-214852.

The silver halide forming the inside nuclei of the core/shell type silver halide grains having the fogged grain inside may have a different halogen composition. As the silver halide having the fogged grain inside or the fogged surface, silver chloride, silver chlorobromide, silver iodobromide, or silver chloroiodobromide can be used.

The mean grain size of these fogged silver halide grains is preferably from 0.01 to 0.75 μm, and particularly preferably from 0.05 to 0.6 μm.

Also, the grain form may be regular grains and the silver halide emulsion may be a polydisperse emulsion but a monodisperse emulsion (at least 95% the weight or the grain number of the silver halide grains has the grain sizes within ±40% of the mean grain size is preferred.

In the present invention, it is preferred to use a light-insensitive fine grain silver halide. The light-insensitive fine grain silver halide is a fine grain silver halide which is not sensitive to light at the imagewise exposure for obtaining dye images and is not substantially developed in development processing thereof and it is preferred that the light-insensitive fine grain silver halide is not previously fogged. The fine grain silver halide has a silver bromide content of from 0 to 100 mole % and, if necessary, may contain silver chloride and/or silver iodide. The fine grain silver halide preferably contains from 0.5 to 10 mole % silver iodide. The mean grain size (the mean value of the circle-equivalent diameters of the projected area) of the fine grain silver halide is preferably from 0.01 to 0.5 μm, and more preferably from 0.02 to 0.2 μm.

The fine grain silver halide can be prepared by the method same as the method of preparing ordinary light-sensitive silver halides. The surface of the silver halide grains is unnecessary be optically sensitized or a spectral sensitization is also unnecessary. In this case, however, it is preferred that a known stabilizer such as a triazole compound, an azaindene compound, a benzothiazolium compound, a mercapto compound, or a zinc compound is added to a coating liquid before adding the fine grain silver halide to the coating liquid. Also, the fine grain silver halide-containing layer can contain colloid silver.

The coated silver amount of the photographic light-sensitive material of the present invention is preferably not more than 6.0 g/m$^2$, and most preferably not more than 4 5 g/m$^2$.

The photographic additives which can be used in the present invention are described in RDs and the relates portions are shown in the following table.

| Kind of Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | — | p. 648, RC | — |
| 3. Spectral Sensitizer Super Sensitizer | pp. 23–24 | p. 648, RC to p. 649, RC | pp. 866–866 |
| 4. Brightening Agent | p. 24 | p. 647, RC | p. 868 |
| 5. Light Absorber, Filter Dye, UV Absorber | pp. 25–26 | p. 649, RC to p. 650, left column (LC) | p. 873 |
| 6. Binder | p. 26 | p. 651, LC | pp. 873–874 |
| 7. Plasticizer, Lubricant | p. 27 | p. 650, RC | p. 876 |
| 8. Coating Aid, Surfactant | pp. 26–27 | p. 650, RC | pp. 875–876 |
| 9. Antistatic Agent | p. 27 | p. 650, RC | pp. 876–877 |
| 10. Matting Agent | — | — | pp. 878–879 |

For the photographic light-sensitive materials of the present invention, various dye-forming couplers can be used but the following couplers are particularly preferred.

Yellow Coupler:

There are the couplers shown by the formulae (I) and (II) described in European Patent 502,424A; the couplers shown by the formulae (1) and (2) described in European Patent 513,496A (in particular, Y-28 on page 18); the couplers shown by the formula (I) described in claim 1 of European Patent 568,037 A; the couplers shown by the formula (I) of lines 45 to 55 in column 1 of U.S. Pat. No. 5,066,576; the couplers shown by the formula (I) described in JP-A-4-274425; the couplers described in claim 1 in page 40 of European Patent 498,381 A1 (in particular, D-35 on page 18); the couplers shown by the formula (Y) (inparticular, Y-1 on page 17 and Y-54 on page 41); and the couplers shown by formulae (II) to (IV) described in column 7, lines 36 to 58 of U.S. Pat. No. 4,476,219 (in particular, II-17 and II-19 (column 17) and II-24 (column 19)).

Magenta Coupler:

There are the couplers L-57 (page 11, right lower column), L-68 (page 12, right lower column), and L-77 (page 13, right lower column) described in JP-A-3-39737; the couplers (A-4)-63 (page 134), (A-4)-73 and (A-4)-75 (page 139) described in European Patent 456,257; the couplers M-4, M-6 (page 26), and M-7 (page 27) described in European Patent 486,965; the coupler M-45 (described in page 19 in European Patent 571,959 A); the coupler M-1 described in page 6 in JP-A-5-204106; and the coupler M-22 (paragraph 0237) described in JP-A-4-362631.

Cyan Coupler:

There are the couplers CX-1, -3. -4, -5, -11, -12, -14, and -15 (pages 14 to 16) described in JP-A-4-204843; the couplers C-7, C-10 (page 35), C-34. C-35 (page 37), (I-1), and (I-17) (pages 42 to 43) described in JP-A-4-43345; and the couplers shown by the formulae (Ia) and (Ib) described in claim 1 of JP-A-6-67385:

Polymer coupler:

There are Couplers P-1 and P-5 described in page 11 in JP-A-2-44345.

As the coupler giving a colored dye having a proper diffusibility, the couplers described in U.S. Pat. No. 4,366,237, British Patent 2,125,570, European Patent 96,570, and German Patent 3,234,533 are preferably used in the present invention.

As the coupler for correcting the unnecessary absorption of the colored dye, the yellow colored cyan couplers shown by the formulae (CI), (CII), (CIII), and (CIV) described in page 5 in European Patent 456,257A1 (especially YC-86 in page 84); the yellow colored magenta couplers ExM-7 (page 202), Ex-1 (page 249), and EX-7 (page 251) described in European Patent 456,257A1; the magenta colored cyan couplers CC-9 (column 8) and CC-13 (column 10) described in U.S. Pat. No. 4,833,069; the coupler (2) (column 8) described in U.S. Pat. No. 4,837,136; and the colorless masking couplers shown by the formula (A) described in claim 1 of WO 92/11575 are preferred (especially exemplified compounds in pages 36 to 45).

As the compounds (including couplers) each releasing a photographically useful compound by causing a reaction with the oxidized product of a color developing agent, there are following compounds.

Development Inhibitor-Releasing Compound:

There are the compounds (in particular, T-101 (page 30), T-104 (page 31), T-113 (page 36), T-131 (page 45), T-144 (page 51), and T-158 (page 58)) shown by the formulae (I), (II), (III), and (IV) described in European Patent 378,236A1; the compounds (in particular D-49 (page 51)) shown by the formula (I) described in page 7 of European Patent 436,938A2; the compounds (in particular, compound (23) (page 11)) shown by the formula (I) described in European Patent 568,037A; and the compounds (in particular, the compound I-(1)in page 29) shown by the formulae (I), (II), and (III) described in pages 5 to 6 of European Patent 440,195A2.

Bleach Accelerator-Releasing Compound:

There are the compounds (in particular, the compounds (60) and (61)in page 61) shown by the formulae (I) and (I') described in page 5 of European Patent 310,125A2; and the compounds (in particular, the compound (7) in page 7) shown by the formula (I) described in claim 1 of JP-A-6-59411.

Ligand-Releasing Compound:

There are the compounds (in particular, the compounds described in column 12, lines 21 to 41) shown by LIG-X described in claim 1 of U.S. Pat. No. 4,555,478.

Leuco Dye-Releasing Compound:

There are the compounds 1 to 6 described in columns 3 to 8 of U.S. Pat. No. 4,749,641.

Fluorescent Dye-Releasing Compound:

There are the compounds (in particular, the compounds 1 to 11 of columns 7 to 10) shown by Coup-Dye described in claim 1 of U.S. Pat. No. 4,774,181.

Development Accelerator- or Fogging Agent-Releasing Compound:

There are the compounds (in particular, the compound (I-22) of column 25) shown by the formulae (1), (2), and (3) described in column 3 of U.S. Pat. No. 4,656,123, and the compounds shown by ExZK-2 described in page 75, lines 36–38 of European Patent 450,637 A2.

Compound releasing a group which becomes a dye by being released:

There are the compounds (in particular, the compounds Y-1 to Y-19 in columns 25 to 36) shown by the formula (I) described in claim 1 of U.S. Pat. No. 4,857,447.

As other additives than couplers, the following compounds are preferred.

Dispersion Medium for Oil-Soluble Organic Compound:

There are the compounds P-3,-5, -16, -19, -25, -30, -42, -49, -54, -55, -66, -81, -85, -86, and -93 described pages 140 to 144 in JP-A-62-215272.

Latex Being Impregnated With Oil-Soluble Organic Compound:

There are the latexes described in U.S. Pat. No. 4,199,363.

Scavenger for Oxidized Product of Developing Agent:

There are the compounds [in particular, the compounds I-(1), -(2), -(6), and -(12) (columns 4 to 5)) shown by the formula (I) described in column 2, lines 54 to 62 in U.S. Pat. No. 4,978,606 and the compounds (in particular, the compound 1 in column 3) shown by the formulae described in column 2, lines 5 to 10 of U.S. Pat. No. 4,923,787.

Stain Inhibitor:

There are compounds shown by formulae (I) to (III) in page 4, lines 30 to 33 (in particular 1-47, -72, III-1, -27 in pages 24 to 28) in European Patent 298321 A Discoloration Inhibitor:

There are the compounds A-6, -7, -20, -21, -23, -24, -25, -26, -30, -37, -40, -42, -48, -63, -90, -92, -94, and -164 (in pages 69 to 118) described in European Patent 298,321A, the compounds II-1 to III-23 (in particular, the compound III-10) described in columns 25 to 38 of U.S. Pat. No. 5,122,444, the compounds I-1 to III-4 (in particular, the compound II-2) described in pages 8 to 12 in European Patent 471,347A, and the compounds A-1 to A-48 (in particular, the compounds A-39 and A-42) described in columns 32 to 40 of U.S. Pat. No. 5,139,931.

Material for reducing the using amount of coloring intensifier or color mixing inhibitor:

There are the compounds I-1 to II-15 (in particular, the compound (I-46) described in pages 5 to 24 in European Patent 411,324A.

Formalin Scavenger:

There are the compounds SCV-1 to SCV-28 (in particular, the compound SCV-8) described in pages 24 to 29 in European Patent 477,932A.

Hardening Agent:

There are the compounds H-i, -4, -6, -8, and -14 described in page 17 in JP-A-1-214845, the compound H-1 to H-54 shown by the formulae (VII) to (XII) described in columns to 23 of U.S. Pat. No. 4,618,573, the compounds H-1 to H-76 (in particular, the compound H-14) shown by the formula (6) described in page 8, right lower column in JP-A-2-214852, and the compounds described in claim 1 of U.S. Pat. No. 3,325,287.

Development Restrainer Precursor:

There are the compounds P-24, -37, and -39 described in pages 6 to 7 in JP-A-62-168139 and the compounds described in claim 1 (in particular, the compounds 28 and 29 in column of U.S. Pat. No. 5,019,492.

Antiseptics, Antifungal Agent:

There are the compounds I-1 to III-43 (in particular, the compounds II-1, II-9, II-10, II-18 and III-25) described in columns 3 to 15 of U.S. Pat. No. 4,923,790.

Stabilizer, Antifoggant:

There are compounds I-1 to (14), in particular I-1, 60, (2) and (13) disclosed in columns 6 to 16 in U.S. Pat. No. 4,923,793, and the compounds 1 to 65 (in particular, the compound 36) described in columns 25 to 32 of U.S. Pat. No. 4,952,483.

Chemical Sensitizer:

There are triphenylphosphine selenide, and the compound 50 described in JP-A-5-40324.

Dye:

There are the compounds a-1 to b-20 (in particular, the compounds a-1, -12, -18, -27, -35, and -36, b-5) in pages 15 to 18 and the compounds V-1 to V-23 (in particular, the compound V-1) in pages 7 to 29 in JP-A-3-156450, the compounds F-I-1 to F-II-43 (in particular, the compounds F-1-11 and F-II-8) described in pages 33 to 55 in European Patent 445,627A, the compounds III-1 to III-36 (in particular, the compounds III-1 and III-3) described in pages 17 to 28 in European Patent 457,153A, the fine crystal dispersions of dye-1 to dye 124 described in pages 8 to 26 in WO 88/04794, the compounds 1 to 22 (in particular, the compound 1) described in pages 6 to 11 in European Patent 319,999A, the compounds D-1 to D-87 (pages 3 to 28) shown by the formulae (1) to (3) described in European Patent 519,306A, the compounds 1 to 22 (columns 3 to 10) shown by the formula (I) described in U.S. Pat. No. 4,268,622, and the compounds (1) to (31) (columns 2 to 9) shown by the formula (I) described in U.S. Pat. No. 4,923,788.

UV Absorber:

There are the compounds (18b) to (18r), the compounds 101 to 427 (pages 6 to 9) shown by the formula (1) described in JP-A-46-3335, the compounds (3) to (66) (page 10 to 44) shown by the formula (I) and the compounds HBT-1 to HBT-10 (page 14) shown by the formula (III) described in European Patent 520,938A, and the compounds (1) to (31) (column 2 to 9) shown by the formula (1) described in European Patent 521,823A.

The present invention can be applied to various color photographic light-sensitive materials such as general or cinne color negative photographic films, color reversal photographic films for slide or television, color photographic papers, color positive photographic films, and color reversal photographic papers. Also, the present invention is suitably applied to film units with lens described in JP-B-2-32615 and JU-B-3-39784 (the term "JU-B" as used herein means an "examined published Japanese utility model application").

Proper supports which can be used in the present invention are described in RD, No. 17643, page 28, RD, No. 18716, page 647, right column to page 648, left column, and RD, No. 307105, page 879.

In the photographic light-sensitive material of the present invention, the sum total of the thickness of the total hydrophilic colloid layers at the side having silver halide emulsion layers is preferably not thicker than 28 μm, more preferably not thicker than 23 μm, far more preferably not thicker than 18 μm, and particularly preferably not thicker than 16 μm. Also, the film swelling speed $T_{1/2}$ is preferably not faster than 30 seconds, and more preferably not faster than 20 seconds. In this invention, $T_{1/2}$ is defined the time that the film thickness reaches ½ of a saturated film thickness when the photographic light-sensitive material is processed in a color developer for 3 minutes and 15 seconds at 30° C., 90% of the maximum swelled film thickness is defined as the saturated film thickness. The film thickness means the film thickness measured under 25° C. and 55% in relative humidity (2 days) and $T_{1/2}$ can be measured by using a swellometer of the type described in A. Green et al., *Photographic Science and Engineering*, Vol. 19, 2, pages 124 to 129. $T_{1/2}$ can be controlled by adding a hardening agent to gelatin as a binder or by changing the time passing condition after coating.

Also, the swelling ratio is preferably from 150 to 400%. The swelling ratio can be calculated by the equation (A–B)/B (wherein A is the maximum swelled film thickness and B is a film thickness) from the maximum swelled film thickness under the condition described above.

In the photographic light-sensitive material of the present invention, it is preferred to form a hydrophilic colloid layer having the sum total of the dry thickness of from 2 to 20 μm on the opposite side of the support to the side having the silver halide emulsion layer(s) (hereinafter, this hydrophilic colloid layer is referred to as a back layer). It is preferred that the back layer contains the light absorber, the filter dye, the UV absorber, the antistatic agent, the hardening agent, the binder, the plasticizer, the lubricant, the coating aid, and/or the surface active agent described above.

The swelling ratio of the back layer is preferably from 150 to 500%.

The photographic light-sensitive material of the present invention can be processed by the ordinary process described in RD, No. 17643, pages 28 to 29, RD, No. 18716, page 651, left column to right column, and RD, No. 307105, pages 880 to 881.

The color developer which is used for developing the photographic light-sensitive material of the present invention is an alkaline aqueous solution of, preferably, an aromatic primary amino color developing agent as the main component. As the color developing agent, an aminophenol compound is also useful but a p-phenylenediamine compound is preferably used and as the specific and preferred example thereof, there are the compounds described in European Patent 556,700A, page 28, lines 43 to 52. These compounds can be used as a mixture of two or more kinds according to the purpose.

The color developer generally contains a pH buffer such as alkali metal carbonates, borates, or phosphates and a development restrainer or an antifogging agent, such as chlorides, bromides, iodides, benzimidazoles, benzothiazoles, and mercapto compounds. If desired, hydrazines such as hydroxylamine, diethylhydroxylamine sulfites, N,N-bis-carboxymethylhydrazine, etc.; various preservatives such as phenylsemicarbazides, triethanolamine, catecholsulfonic acids, etc.; organic solvents such as ethylene glycol, diethylene glycol, etc.; development accelerators such as benzyl alcohol, polyethylene glycol, quaternary ammonium salts, amines, etc.; dye-forming couplers; competing couplers; auxiliary developing agents such as 1-phenyl-3-pyrazolidone, etc.; tackifiers; various chelating agents such as aminopolycarboxylic acids, aminopolysulphosphonic acid, alkylphosphonic acids, phosphonocarboxylic acids, etc. for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and the salts of them are added to the color developer.

In the case of practicing reversal processing, usually, after carrying out a black and white development, a color development is carried out. For the black and white development, known black and white developing agents such as dihydroxybenzenes (e.g., hydroquinone), 3-pyrazolidones (e.g., 1-phenyl-3-pyrazolidone), and aminophenols (e.g., N-methyl-p-aminophenol) can be used singly or as a combination thereof.

The pH of the color developer and the black and white developer is generally from 9 to 12. Also, the replenishing amount for these developers depends upon the kind of the color photographic light-sensitive material to be processed but is generally not more than 3 liters per square meter of the photographic light-sensitive material and by reducing the bromide ion concentration in the replenisher, the replenishing amount can be reduced below 500 ml. In the case of reducing the replenishing amount, it is preferred to prevent the occurrences of the evaporation of the liquid and the air oxidation of the developer by reducing the contact area of the processing tank and air.

The processing effect by the contact of a photographic processing liquid with air in a processing tank can be evaluated by an opening ratio (=[contact area ($cm^2$) of processing liquid with air]÷[volume ($cm^3$) of the processing liquid]). The opening ratio is preferably 0.1 or lower, and more preferably from 0.001 to 0.05.

As a method of reducing the opening ratio, there are, in addition to the method of placing a cover such as a floating lid, etc., on the surface of the photographic processing liquid in a processing tank, the method of using a movable lid described in JP-A-1-82033 and the slit development processing method described in JP-A-63-216050.

It is preferred that the opening ratio is reduced not only in the steps of the color development and the black and white development but also in the subsequent various steps of, e.g., bleach, bleach-fix (blix), fix, wash, stabilization, etc.

Also, by using a method of restraining the accumulation of bromide ions in a developer, the replenishing amount can be reduced.

The time for the color development is usually from 2 to 5 minutes but by increasing the temperature and pH and increasing the concentration of a color developing agent, the processing time can be more shortened.

After color development, the photographic light-sensitive material is usually subjected to bleach processing. The bleach processing may be carried out simultaneously with fix processing (blix processing) or may be carried out separately from fix processing. Furthermore, for quickening processing, a processing method of carrying out blix processing after bleach processing may be employed. Furthermore, a process of carrying out blix processing by two tanks, a process of carrying out fix processing before blix processing, or a process of carrying out bleach processing after blix processing can be practiced according to the purposes.

As the bleaching agent, a compound of a polyvalent metal such as iron(III), a peroxide, a quinone, a nitro compound, etc., is used. As the typical bleaching agent, organic complex salts of iron (III), for example, the complex salts with aminopolycarboxylic acids (such as, ethylenediaminetetraacetic acid, diethylenetriaminepentaacetic acid, cyclohexanediaminetetraacetic acid, methyliminodiacetic acid, 1,3-diaminipropanetetraacetic acid, glycol ether diaminetetraacetic acid, etc.), citric acid, tartaric acid, malic acid, etc., can be used. In these complex salts, aminopolycarboxylic acid iron(III) complex salt such as ethylenediaminetetraacetic acid iron(III) complex salt and 1,3-diaminopropanetetraacetic acid iron(III) complex salt is preferred from the view points of quick processing and the prevention of an environmental pollution. Furthermore, the aminopolycarboxylic acid iron(III) complex salt is particularly useful for a bleach liquid and a blix liquid.

The pH of the bleach liquid or the blix liquid using the aminopolycarboxylic acid iron(III) complex salt is usually from 4.0 to 8 but the pH can be more lowered for quickening processing.

For the bleach liquid, the blix liquid, and the prebath thereof, if desired, a bleach accelerator can be used. Specific examples of the useful bleach accelerator are shown below.

That is, there are the compounds having a mercapto group or a disulfide group described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD, No. 17129 (July, 1978); the thiazolidine derivatives described in JP-A-50-140129; the thiourea derivatives described in JP-B-45-8506, JP-A-52-20832, JP-A-53-32735, and U.S. Pat. No. 3,706,561; the iodides described in German Patent 1,127,715 and JP-A-58-16235; the polyoxyethylene compounds described in German Patents 966,410 and 2,748,430; the polyamine compounds described in JP-B-45-8836; the compounds described in JP-A-49-40943, JP-A-49-59644, JP-A-53-94927, JP-A-54-35727, JP-A-55-26506, and JP-A-58-163940, and bromide ions.

In these compounds, the compounds having a mercapto group or a disulfide group are preferred from the view point of giving a large acceleration effect. Compounds disclosed in U.S. Pat. No. 3,893,858, German Patent 1,290,812 and JP-A-53-95,630 are preferred. Furthermore, the compounds described in U.S. Pat. No. 4,552,834 are also preferred.

These bleach accelerators may be added into the photographic light-sensitive materials. When a color photographic light-sensitive material for photographing is blixed, these bleach accelerators are particularly effective.

It is preferred that the bleach liquid or the blix liquid contains an organic acid for the purpose of preventing the occurrence of a bleach stain in addition to the above-described compounds. The particularly preferred organic acid is a compound having an acid dissociation constant (pKa) of from 2 to 5 and specifically, acetic acid, propionic acid, hydroxyacetic acid, etc., are preferred.

As a fixing agent being used for the fix liquid or the blix liquid, there are thiosulfates, thiocyanates, thioether compounds, thioureas, a large amount of iodides, etc., but the use of a thiosulfate is general and in particular, ammonium thiosulfate can be used in the most wide range. The use of a thiosulfate together with a thiocyanate, a thioether compound, or a thiourea is also preferred.

As the preservatives for the fix liquid or the blix liquid, sulfites, bisulfites, carbonyl-bisulfites addition products, and the sulfinic acid compounds described in European Patent 294,769A are preferably used. Furthermore, for the fix liquid or the blix liquid, the addition of an aminopolycarboxylic acid or an organic phosphonic acid is preferred for the purpose of stabilizing the liquid.

In the present invention, it is preferred to add a compound having pKa of from 6.0 to 9.0, preferably an imidazole such as imidazole, 1-methylimidazole, 1-ethylimidazole, 2-methylimidazole, etc., to the fix liquid or the blix liquid in an amount of from 0.1 to 10 moles per liter of the liquid for controlling the pH of the liquid.

The sum total of the time for the desilvering steps is preferably shorter in the range of not causing inferior desilvering. The time is preferably from 1 minute to 3 minutes, and more preferably from 1 minute to 2 minutes.

Also, the processing temperature is from 25° C. to 50° C., and preferably from 35° C. to 45° C. In the preferred temperature range, the desilvering speed is improved and the occurrence of stains after processing can be effectively prevented.

In the desilvering steps, it is preferred that stirring is strengthened as strong as possible. As a practical method of strengthening stirring, there are the method of striking the emulsion surface of the photographic light-sensitive material with the jet stream of the processing liquid described in JP-A-62-183460, the method of increasing the stirring effect using a rotation means described in JP-A-62-183461, the method of improving the stirring effect by moving the photographic light-sensitive material while contacting the emulsion surface with a wiper blade equipped in the liquid to cause a turbulent flow at the emulsion surface, and the method of increasing the circulating amount of the whole processing liquid. Such a stirring means is also effective for the bleach liquid, blix liquid, and the fix liquid.

It is considered that the improvement of stirring hastens the supply of a bleaching agent and/or the fixing agent into the emulsion layers, which results in increasing the desilvering speed. Also, the foregoing stirring-improving means is more effective in the case of using a bleach accelerator, whereby the acceleration effect can be greatly increased and also the fixing obstructing action by the bleach accelerator can be prevented.

It is preferred that an automatic processor being used for processing the photographic light-sensitive material of the present invention has the photographic light-sensitive material transport means as described in JP-A-60-191257, JP-A-60-191258, and JP-A-60-191259. As described in JP-A-60-191257 described above, such a transport means can greatly reduced the amount of the processing liquid carried from a pre-bath to a post-bath, gives a high effect of preventing the deterioration of the properties of the processing liquid, and is particularly effective for shortening the processing time in each step and the reduction of the replenishing amount for the processing liquid.

The photographic light-sensitive material of the present invention is generally subjected to a wash step and/or a stabilization step after desilvering processing.

The amount of wash water in the wash step can be selected in a wide range according to various factors such as the characteristics (e.g., by the using materials such as couplers, etc.) and the use of the color photographic light-sensitive material, the temperature of wash water, the number (stage number) of wash tanks, the replenishing system such as a countercurrent system or a normal current system, etc.

In these factors, the relation of the number of wash tanks and the amount of water can be determined by the method described in *Journal of the Society of Motion Picture and Television Engineers*, Vol. 64, pages 248–253(May, 1955). According to the multistage countercurrent system described in the above publication, the amount of wash water can be greatly reduced but by the increase of the residence time of water in the tanks, bacteria grow to cause a problem that floats formed attach to the photographic light-sensitive material processed. As a counterplan for solving the problem, the method of reducing calcium ions and magnesium ions described in JP-A-62-288838 is very effective. Also, the isothiazolone compounds described in JP-A-57-8542, thiabendazoles, chlorine-containing fungicides such as chlorinated sodium isocyanuric acid, etc., benzotriazoles, and the fungicides described in Hiroshi Horiguchi, *Bokin Bobai Zai no Kagaku* (*Chemistry of Antibacterial and Antifungal Agents*), published by Sankyo K. K.; *Biseibutsu no Mekkin, Sakkin, Boubai Gijyutsu* (*Sterilization and Antifungal Technique of Microorganisms*), published by Kogyo Gijyutsu Kai, 1982; and *Bokin Bobai Zai Jiten* (*Antibacterial and Antifungal Agent Handbook*), 1986 can be used.

The pH of wash water in processing of the photographic light-sensitive material of this invention is from 4 to 9, and preferably from 5 to 8. The temperatur of wash water and the washing time can be suitably selected according to the characteristics and the use of the photographic light-sensitive material but are generally selected in the ranges of from 15° C. to 45° C. and from 20 seconds to 10 minutes, and preferably from 25° C. to 40° C. and from 30 seconds to 5 minutes.

Furthermore, the photographic light-sensitive material of this invention can be directly processed by a stabilization liquid in place of wash water. In such stabilization processing, the known processes described in JP-A-57-8543, JP-A-58-14834, and JP-A-60-220345 can be applied.

Also, as the case may be, after wash processing described above, stabilization processing is further carried out and as an example, there is a stabilization bath containing a dye stabilizer and a surface active agent being used as the final bath for processing a color photographic light-sensitive material for photographing. As the dye stabilizer, there are aldehydes such as formalin, glutar-aldehyde, etc., N-methylol compounds, hexamethylenetetramine, and aldehyde-sulfite addition products. To the stabilization bath can be added various chelating agents and antifungal agents.

The overflow liquid with replenishing wash water and/or the stabilization liquid described above can be reutilized for the desilvering steps, etc.

In the processing using an automatic processor, etc., when each processing liquid is concentrated by evaporation, it is preferred to add water for correct the concentrated liquid.

The photographic light-sensitive material of the present invention may contain therein a color developing agent for simplifying and quickening processing. In this case, for incorporating a color developing agent to the photographic light-sensitive material, it is preferred to use a precursor of the color developing agent. As such a precursor, there are, for example, the indoaniline compounds described in U.S. Pat. No. 3,342,597; the Schiff base-type compounds described in U.S. Pat. No. 3,342,599, RD, No.14,850, and RD, No. 15159; the aldol compounds described in RD, No. 13924; the metal salt complexes described in U.S. Pat. No. 3,719,492; and the urethane compounds described in JP-A-53-135628.

The color photographic light-sensitive material of this invention may, if necessary, contain therein a 1-phenyl-3-pyrazolidone for accelerating the color development. Typical examples of the compound are described in JP-A-56-64339, JP-A-57-144547, and JP-A-58-115438.

The processing liquids used for processing the photographic light-sensitive material of the present invention are used at a temperature of from 10° C. to 50° C. Usually, a temperatur of from 33° C. to 38° C. is standard but by increasing the temperature, the processing is accelerated to shorten the processing time or by lowering the processing temperature, the image quality can be improved and also the stability of the processing liquids can be improved.

The present invention will be illustrated with reference to examples below, but these are not to be construed as limiting the invention.

EXAMPLE 1

A cellulose triacetate support having an under coat was coated with respective layers having the following composition in multiple layers to prepare sample 101, a multilayer color photographic material.

(Photographic Layer Composition)

Materials used in the respective layers are classified as follows:

ExC: Cyan Coupler UV: Ultraviolet Absorber

ExM: Magenta Coupler

HBS: High Boiling Organic Solvent

ExY: Yellow Coupler H: Hardening Agent for Gelatin

ExS: Sensitizing Dye

Numerals corresponding to respective components indicate the coated amount represented by the g/m$^2$ unit. For silver halides, numerals indicate the coated amount converted to silver. However, for sensitizing dyes, numerals indicate the coated amount per mol of silver halide contained in the same layer by the mol unit.

| (Sample 101) | |
|---|---|
| First Layer (Antihalation Layer) | |
| Black Colloidal Silver | silver 0.09 |
| Gelatin | 1.60 |
| ExM-1 | 0.12 |
| ExF-1 | $2.0 \times 10^{-3}$ |
| Solid Disperse Dye ExF-2 | 0.030 |

(Sample 101)

| | |
|---|---|
| Solid Disperse Dye ExF-3 | 0.040 |
| HBS-1 | 0.15 |
| HBS-2 | 0.02 |
| Second Layer (Intermediate Layer) | |
| Silver Iodobromide Emulsion M | silver 0.065 |
| ExC-2 | 0.04 |
| Polyethyl Acrylate Latex | 0.20 (solid) |
| Gelatin | 1.04 |
| Third Layer (Red-Sensitive Emulsion Layer of Low Sensitivity) | |
| Silver Iodobromide Emulsion A | silver 0.3 |
| Silver Iodobromide Emulsion B | silver 0.3 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Fourth Layer (Red-Sensitive Emulsion Layer of Middle Sensitivity) | |
| Silver Iodobromide Emulsion C | silver 0.8 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| Fifth Layer (Red-Sensitive Emulsion Layer of High Sensitivity) | |
| Silver Iodobromide Emulsion D | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| Sixth Layer (Intermediate Layer) | |
| Cpd-1 | 0.090 |
| Solid Disperse Dye ExF-4 | 0.030 |
| HBS-1 | 0.050 |
| Polyethyl Acrylate Latex | 0.15 |
| Gelatin | 1.10 |
| Seventh Layer (Green-Sensitive Emulsion Layer of Low Sensitivity) | |
| Silver Iodobromide Emulsion E | silver 0.15 |
| Silver Iodobromide Emulsion F | silver 0.10 |
| Silver Iodobromide Emulsion G | silver 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

(Sample 101)

| | |
|---|---|
| Eighth Layer (Green-Sensitive Emulsion Layer of Medium Sensitivity) | |
| Silver Iodobromide Emulsion H | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| Ninth Layer (Green-Sensitive Emulsion Layer of High Sensitivity) | |
| Silver Iodobromide Emulsion I | silver 1.30 |
| ExS-4 | $3.7 \times 10^{-3}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 (solid) |
| Gelatin | 1.33 |
| Tenth Layer (Yellow Filter Layer) | |
| Yellow Colloidal Silver | silver 0.015 |
| Cpd-1 | 0.16 |
| Solid Disperse Dye ExF-5 | 0.060 |
| Solid Disperse Dye ExF-6 | 0.060 |
| Oil-Soluble Dye ExF-7 | 0.010 |
| HBS-1 | 0.60 |
| Gelatin | 0.60 |
| Eleventh Layer (Blue-Sensitive Emulsion Layer of Low Sensitivity) | |
| Silver Iodobromide Emulsion J | silver 0.09 |
| Silver Iodobromide Emulsion K | silver 0.09 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Twelfth Layer (Blue-Sensitive Emulsion Layer of High Sensitivity) | |
| Silver Iodobromide Emulsion L | silver 1.00 |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth Layer (First Protective Layer) | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| ExF-8 | 0.009 |
| ExF-9 | 0.027 |
| ExF-10 | 0.015 |
| Gelatin | 1.8 |

-continued

| (Sample 101) | |
|---|---|
| Fourteenth Layer (Second Protective Layer) | |
| Silver Iodobromide Emulsion M | silver 0.10 |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.70 |

In addition, the respective layers appropriately contain any of W-1 to W-3, B-4 to B-6, F-1 to F-17, iron salts, lead salts, gold salts, platinum salts, iridium salts, palladium salts and rhodium salts to improve preservability, processability, pressure durability, mold proofing, bacteria proofing, antistatic quality and coating quality.

K. K. was used for dispersion. After dispersion, the contents were taken out, and added to 8 g of a 12.5% aqueous solution of gelatin. The beads were filtered off to obtain a gelatin dispersion of the dye. The mean grain size of fine particles of the dye was 0.44 μm.

Similarly, solid dispersions of ExF-3, ExF-4 and ExF-6 were obtained. The mean grain sizes of fine particles of those dyes were 0.24 μm, 0.45 μm and 0.52 μm, respectively. ExF-5 was dispersed according to a microprecipitation dispersing technique described in Example 1 of EP-A-549, 489A. The mean grain size was 0.06 μm.

TABLE 1

| Emulsion | Mean AgI Content (%) | Coefficient of Variation Relating to AgI Content among Grains (%) | Mean Grain Size (Sphere-Corresponding Diameter) (μm) | Coefficient of Variation Relating to Grain Size (%) | Diameter of Projected Area (Circle-Corresponding Diameter) (μm) | Diameter/Thickness Ratio |
|---|---|---|---|---|---|---|
| A | 1.7 | 10 | 0.46 | 15 | 0.56 | 1.8 |
| B | 3.5 | 15 | 0.57 | 20 | 0.78 | 1.4 |
| C | 8.9 | 25 | 0.66 | 25 | 0.87 | 1.8 |
| D | 8.9 | 18 | 0.84 | 26 | 1.03 | 1.2 |
| E | 1.7 | 10 | 0.46 | 15 | 0.56 | 1.8 |
| F | 3.5 | 15 | 0.57 | 20 | 0.78 | 1.4 |
| G | 8.8 | 25 | 0.61 | 23 | 0.77 | 1.5 |
| H | 8.8 | 25 | 0.61 | 23 | 0.77 | 1.5 |
| I | 8.9 | 18 | 0.84 | 26 | 1.03 | 1.2 |
| J | 1.7 | 10 | 0.46 | 15 | 0.50 | 1.4 |
| K | 8.8 | 18 | 0.64 | 23 | 0.85 | 1.7 |
| L | 14.0 | 25 | 1.28 | 26 | 1.46 | 1.2 |
| M | 1.0 | — | 0.07 | 15 | — | 1 |

In Table 1, (1) emulsions J to L were subjected to reduction sensitization by use of thiourea dioxide and thiosulfonic acid in preparing grains according to the examples of JP-A-2-191938; (2) emulsions A to I were subjected to gold sensitization, sulfur sensitization and selenium sensitization in the presence of the spectrally sensitizing dyes described for the respective light-sensitive layers and sodium thiocyanate according to the examples of JP-A-3-237450; (3) low molecular weight gelatin was used for the preparation of the tabular grains according to the examples of JP-A-1-158426; (4) dislocation lines as described in JP-A-3-237450 were observed under a high-voltage electron microscope for the tabular grains; and (5) emulsion L contained double structural grains containing internal high iodine cores described in JP-A-60-143331.

Preparation of Dispersions of Organic Solid Dispersing Dyes

ExF-2 described below was dispersed according to the following procedure. To a 700-ml pot mill were placed 21.7 ml of water, 3 ml of 5% aqueous solution of sodium p-octylphenoxyethoxyethoxyethanesulfonate and 0.5 g of a 5% aqueous solution of p-octylphenoxypolyoxyethylene ether (degree of polymerization: 10) and 5.0 g of dye ExF-2, and 500 ml of zirconium beads (diameter: 1 mm) were added to the mixture, and the contents were dispersed for 2 hours. A BO-type vibrating ball mill manufactured by Chuo Kohki ExC-1
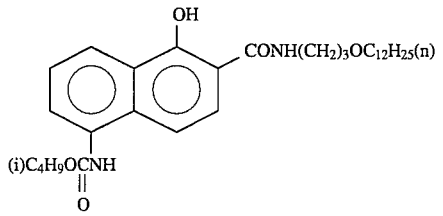
ExC-2
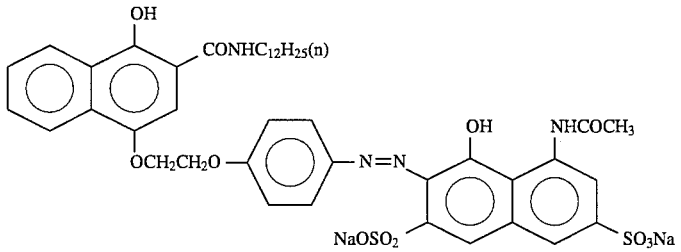
ExC-3
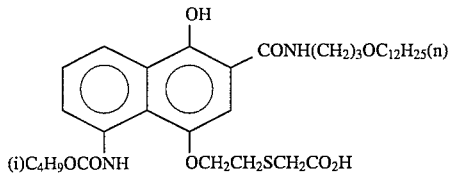
ExC-4
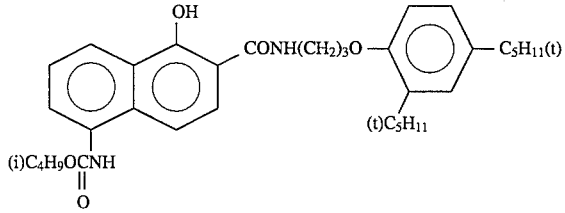
ExC-5
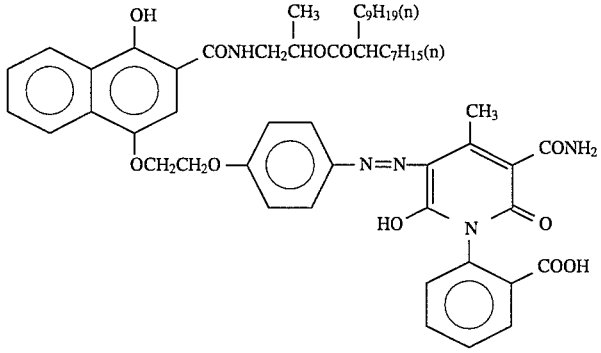
ExC-6
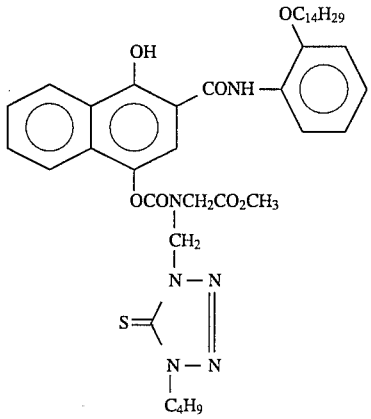

-continued
ExC-7
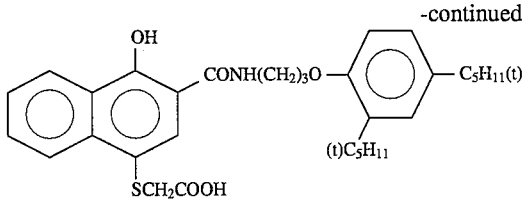
ExC-8
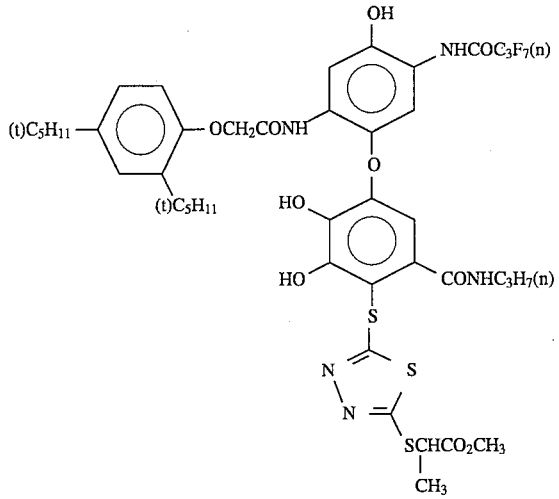
ExM-1
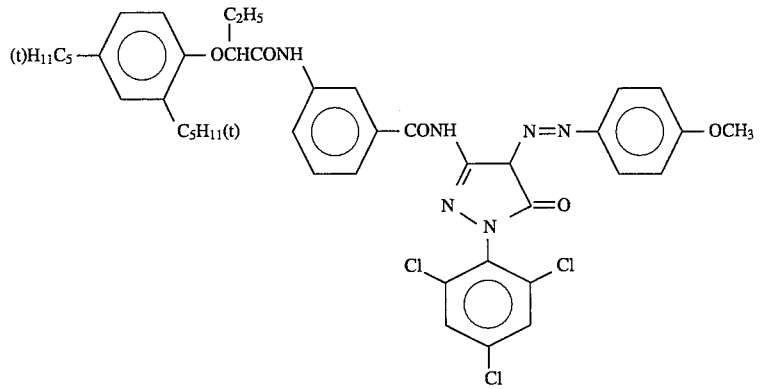
ExM-2
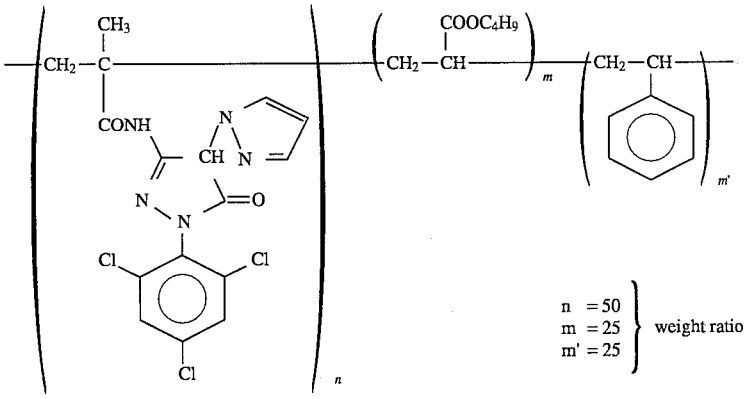
Mol. wt.: ca. 20,000

-continued
ExM-3
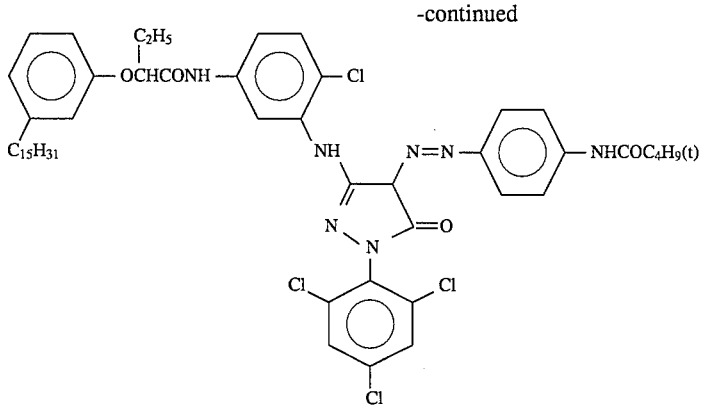
ExM-4
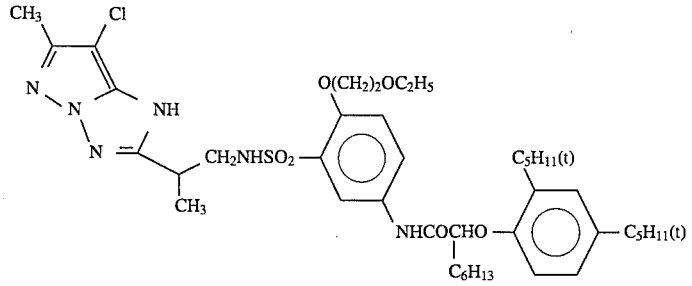
ExM-5
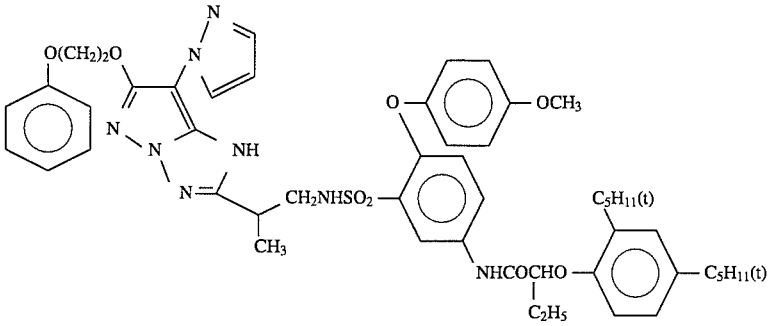
ExY-1
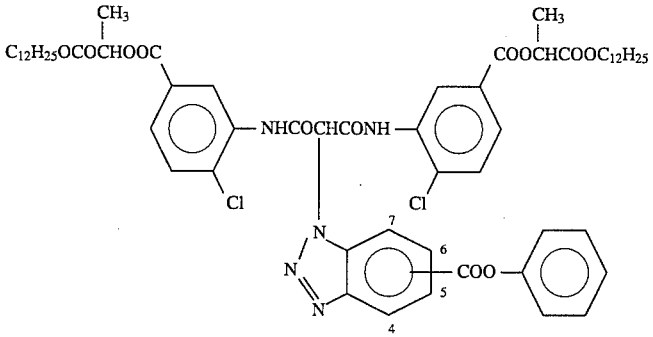
(a mixture of compounds of 5- or 6-substituted: the same hereinafter)

-continued
ExY-2
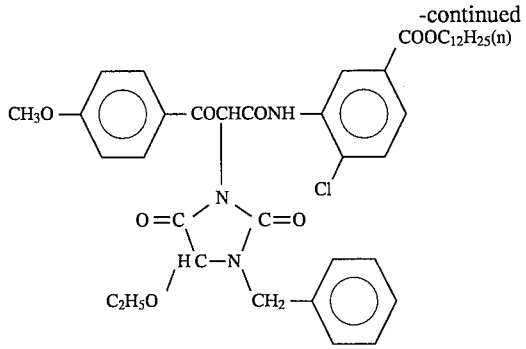
ExY-3
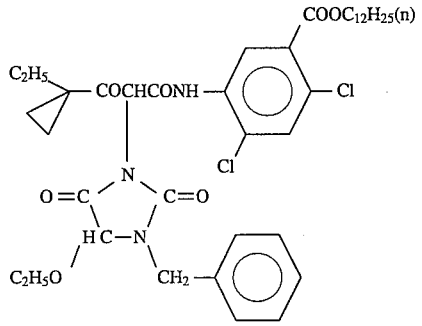
ExY-4
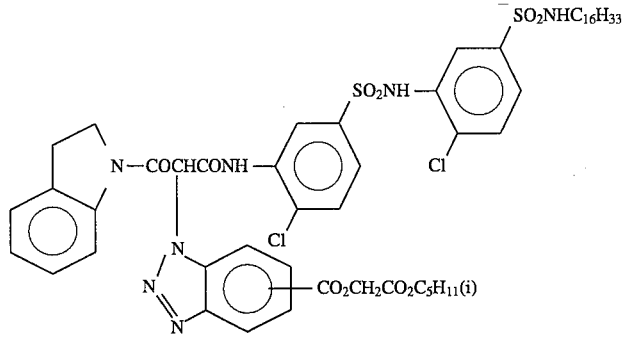
ExY-5
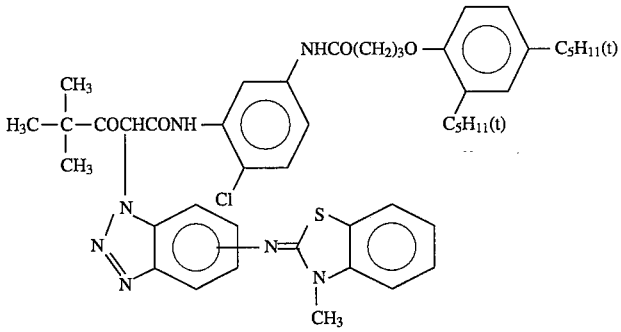
ExF-1
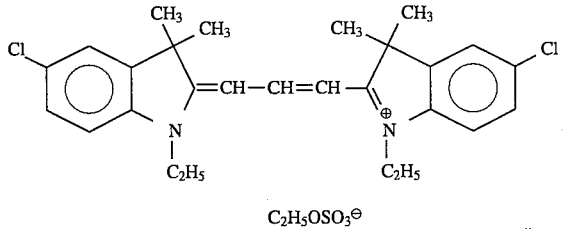

-continued
ExF-2
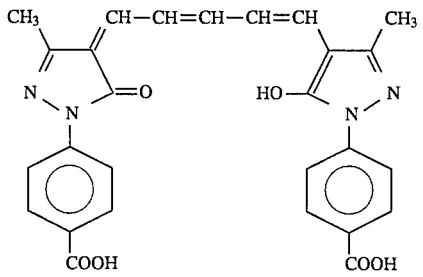
ExF-3
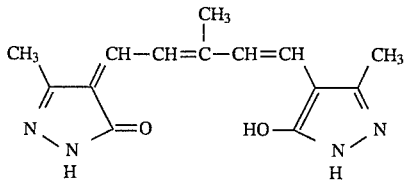
ExF-4
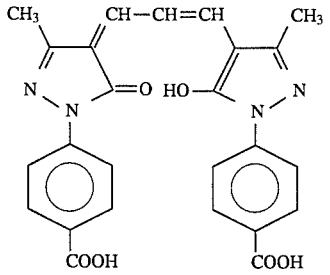
ExF-5
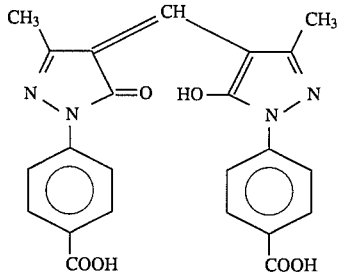
ExF-6
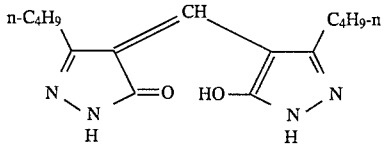
ExF-7
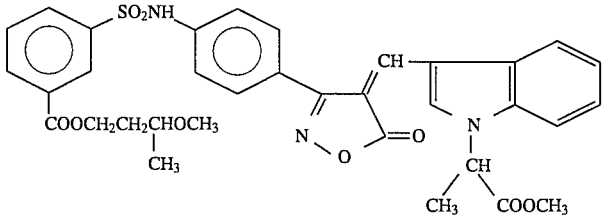
ExF-8
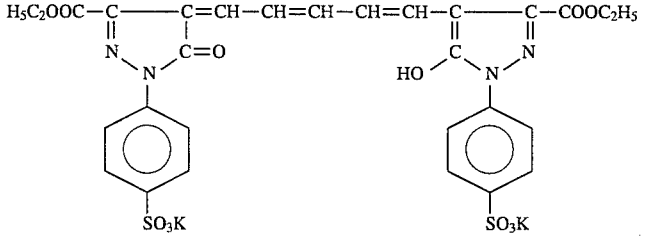

-continued
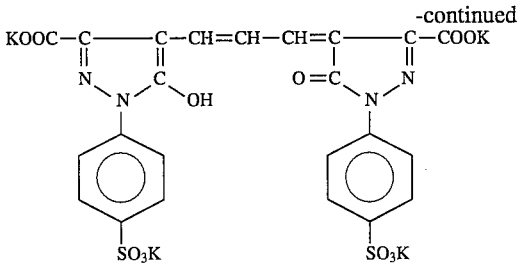
ExF-9
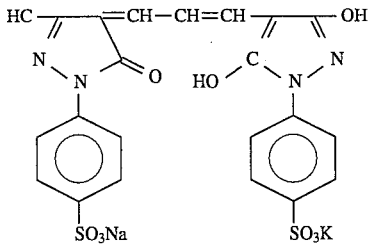
ExF-10
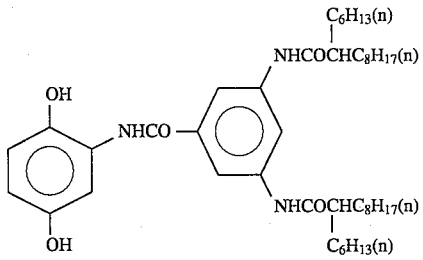
Cpd-1
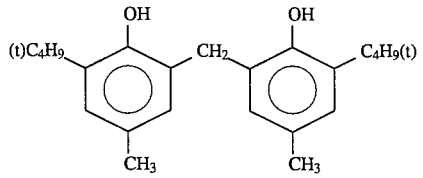
Cpd-2
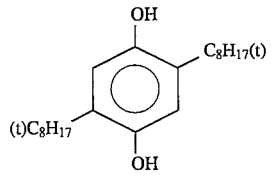
Cpd-3
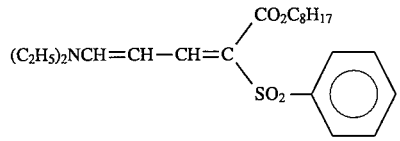
UV-1
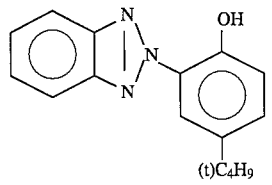
UV-2
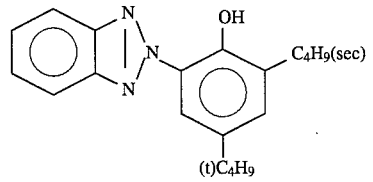
UV-3
Tricresyl Phosphate
HBS-1

-continued
Di-n-butyl Phthalate HBS-2
HBS-3
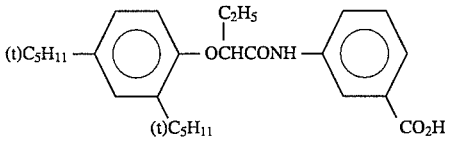
Tri(2-ethylhexyl) Phosphate HBS-4
ExS-1
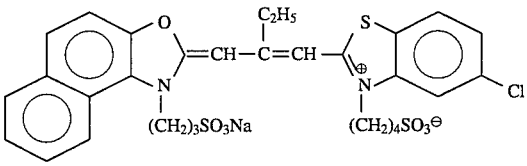
ExS-2
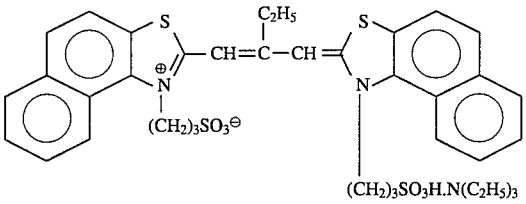
ExS-3
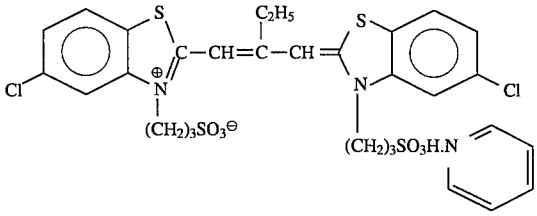
ExS-4
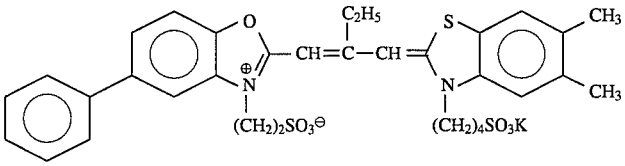
ExS-5
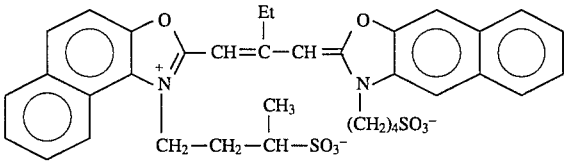
ExS-6
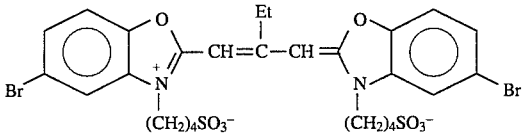
ExS-7
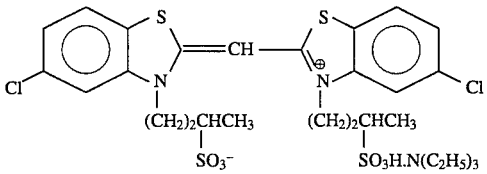
S-1
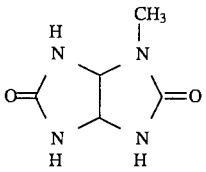

-continued
H-1
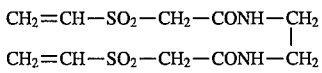
B-1
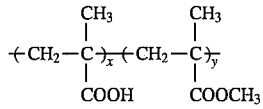
x/y = 10/90 (weight ratio)
B-2
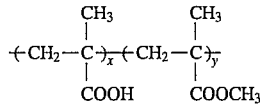
x/y = 40/60 (weight ratio)
B-3
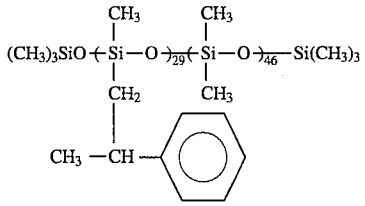
B-4
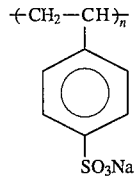
(average molecular weight: 750,000)
B-5
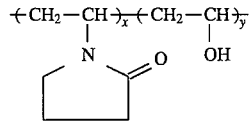
x/y = 70/30 (weight ratio)
B-6
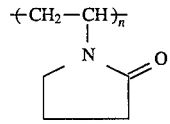
(mol. wt. about 10,000)
W-1
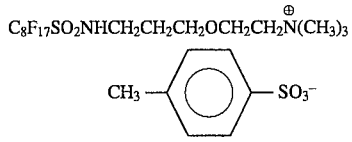
W-2
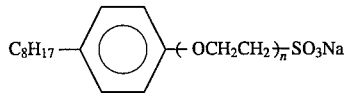
(a mixture of n = 2~4)
W-3
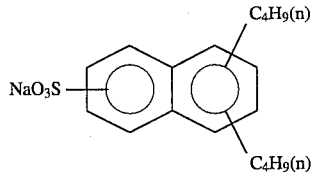
F-1
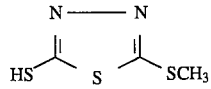

-continued
F-2
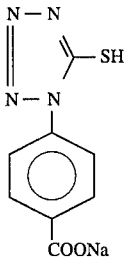
F-3
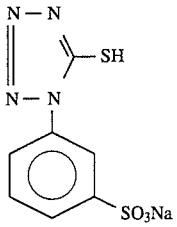
F-4
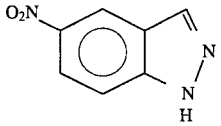
F-5
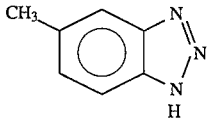
F-6
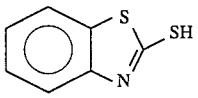
F-7
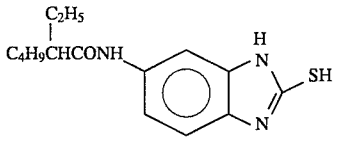
F-8
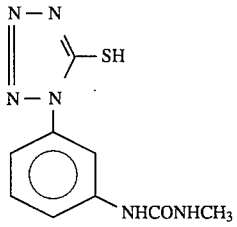
F-9
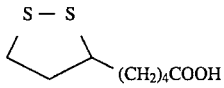
F-10
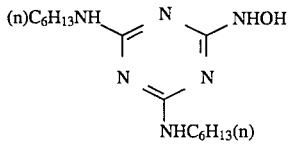
F-11
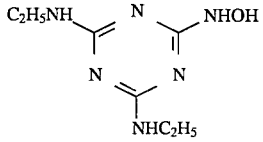

-continued

F-12

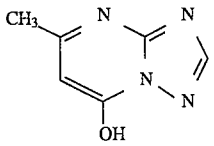

F-13

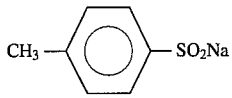

F-14

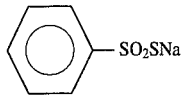

F-15

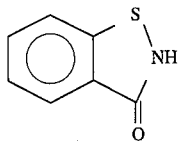

F-16

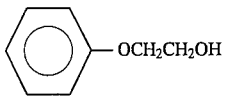

F-17

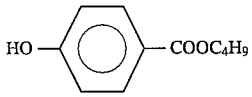

Preparation of Sample 102

Sample 102 was prepared in the same manner as sample 101, except that compound A-3 of the present invention was added in an amount of 0.01 g/m$^2$ to the 9th layer.

Preparation of Samples 103 to 114

Samples 103 to 114 were prepared in the same manner as sample 102, except that the emulsion of the 9th layer was replaced by the same silver amount of the emulsions shown in Table 2 and A-3 was replaced by the equimolar amount of the compounds shown in Table 2.

Preparation of Sample 115

Sample 115 was prepared in the same manner as sample 106, except that comparative compounds A and B were added in amounts of $1.9\times10^{-4}$ mole and $1.0^{10-4}$ mole per mole of silver contained in the 9th layer, respectively.

Comparative Compound A

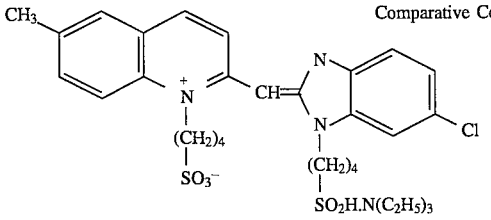

Comparative Compound B (a compound described in JP-A-5-150390)

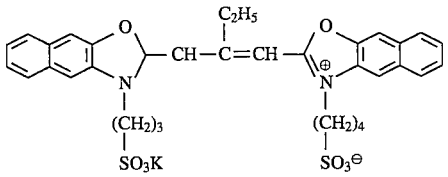

Emulsions N, O and P were prepared in the same manner as emulsion I, except that only the aspect ratio was changed as shown in Table 2. In each of Emulsions N, O and P, 90% or more of silver halide grains had 30 or more of dislocation lines per grain.

The thus prepared samples were subjected to the following evaluations:

Sensitivity

After wedge exposure to a sample with white light, the sample was subjected to development processing according to the following steps. Sensitivity was shown by the logarithm of the reciprocal of an exposure required to give a minimum density of a magenta color image+0.2 (a relative value to sample 101).

Durability to Pressure

Under a condition of a relative humidity of 50% and a temperature of 25° C., a sample was fixed at one end thereof with the surface coated with an emulsion facing inward, and bent around a stainless pipe having a diameter of 10 nun rotating in an angle of 180° at a bending speed of 360°/second.

Thereafter, sensitivity was evaluated in the same manner as the above-mentioned evaluation of sensitivity. Exposure was effected 10 seconds later after bending.

Evaluation of Fogging with Time

One portion of a sample was allowed to stand for 6 months under conditions of 35° C.-60% (RH) and the other portion of the sample was stored under refrigeration for 6 months. Both the portions were exposed and developed in the same manner as above, and fogging with the lapse of time was evaluated by the difference in minimum density between green-sensitive layers thereof.

The photographic materials were exposed as described above, and then, processed using a Negaprocessor FP-350 manufactured by Fuji Photo Film Co., Ltd. according to a method described below (until the accumulative replenishment amount of a color developing solution reached 3 times the mother liquor tank capacity thereof).

Processing Method

| Step | Processing Time | Processing Temperature | Replenishment Rate*1 |
|---|---|---|---|
| Color Development | 3 min 15 sec | 38° C. | 45 ml |
| Bleaching*2 | 1 min 00 sec | 38° C. | 20 ml |
| Bleaching-Fixing | 3 min 15 sec | 38° C. | 30 ml |
| Washing with water (1) | 40 sec | 35° C. | *3 |
| Washing with water (2) | 1 min | 35° C. | 30 ml |
| Stabilization | 40 sec | 38° C. | 20 ml |
| Drying | 1 min 15 sec | 55° C. | |

*1per 3.5 mm in width × 1.1 m in length (corresponding to a roll of 24 exposures).
*2All quantity of overflowed bleaching solution runs into the bleaching-fixing tank.
*3A countercurrent piping system from (2) to (1).

Compositions of processing solutions are as follows:

| Color Developer | Tank Solution (g) | Replenisher (g) |
|---|---|---|
| Diethylenetriamine-pentaacetic acid | 1.0 | 1.1 |
| 1-Hydroxyethylidene-1,1-diphosphonic acid | 2.0 | 2.0 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-(N-ethyl-N-(β-hydroxyethyl)-amino)-2-methylaniline sulfate | 4.5 | 5.5 |
| Water to make | 1 liter | 1 liter |
| pH (adjusted with potassium hydroxide and sulfuric acid) | 10.05 | 10.10 |

-continued

| Bleaching Solution (common to both the tank solution and the replenisher) (unit: g) | |
|---|---|
| Ferric Ammonium Ethylenediaminetetra-acetate Dehydrate | 120.0 |
| Disodium Ethylenediaminetetraacetate | 10.0 |
| Ammonium Bromide | 100.0 |
| Ammonium Nitrate | 10.0 |
| Bleaching Promoter $(CH_3)_2N\text{-}CH_2\text{-}CH_2\text{-}S\text{-}S\text{-}CH_2\text{-}CH_2\text{-}N\ (CH_3)\cdot 2HCl$ | 0.005 mole |
| Aqueous Ammonia (27%) | 15.0 ml |
| Water to make | 1.0 liter |
| pH (adjusted with aqueous ammonia and nitric acid) | 6.3 |

| Bleaching-Fixing Solution) | Tank Solution (g) | Replenisher (g) |
|---|---|---|
| Ferric Ammonium Ethylenedi-aminetetraacetate Dehydrate | 50.0 | — |
| Disodium Ethylenediamine-tetraacetate | 5.0 | 2.0 |
| Sodium Sulfite | 12.0 | 20.0 |
| Ammonium Thiosulfate Aqueous Solution (700 g/liter) | 240.0 ml | 400.0 ml |
| Aqueous Ammonia (27%) | 6.0 ml | — |
| Water to make | 1.0 liter | 1.0 liter |
| pH (adjusted with aqueous ammonia and acetic acid) | 7.2 | 7.3 |

Washing Liquid/common to both the tank solution and the replenisher)

Service water was passed through a mix bed column charged with an H type strongly acidic cation exchange resin (Amberlite IR-120B, manufactured by Rhom & Haas) and an OH type strongly basic anion exchange resin (Amberlite IR-400, manufactured by Rhom & Haas) to reduce the concentration of calcium and magnesium ions to 3 mg/liter. Subsequently, 20 mg/liter of sodium dichloroisocyanurate and 1.5 g/liter of sodium sulfate were added thereto. The pH of the resulting solution was within the range of 6.5 to 7.5.

| Stabilizing Solution (common to both the tank solution and the replenisher) (unit: g) | |
|---|---|
| Sodium p-Toluenesulfinate | 0.03 |
| Polyoxyethylene-p-monononylphenyl Ether (Average Polymerization Degree: 10) | 0.2 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 liter |
| pH | 8.5 |

TABLE 2

| Sample No. | Emulsion in Ninth Layer | Compound in Ninth Layer | Sensitivity of Unpressurized Portion | Pressurized Portion Fogging*1 | Pressurized Portion Sensitivity*2 | Fogging with Time | Note |
|---|---|---|---|---|---|---|---|
| 101 | I [20%] (1.2) | — | control | +0.26 | −0.01 | +0.04 | Comparison |
| 102 | I [20%] (1.2) | A-3 | +0.01 | +0.22 | −0.02 | +0.04 | Comparison |
| 103 | N [60%] (2.2) | A-3 | +0.04 | +0.15 | −0.01 | +0.03 | Invention |
| 104 | O [70%] (3.7) | A-3 | +0.05 | +0.12 | −0.01 | +0.03 | Invention |
| 105 | P [99%] (5.2) | A-3 | +0.06 | +0.11 | −0.01 | +0.03 | Invention |
| 106 | P [99%] (5.2) | — | +0.04 | +0.30 | −0.05 | +0.09 | Comparison |

TABLE 2-continued

| Sample No. | Emulsion in Ninth Layer | Compound in Ninth Layer | Sensitivity of Unpressurized Portion | Pressurized Portion Fogging*1 | Pressurized Portion Sensitivity*2 | Fogging with Time | Note |
|---|---|---|---|---|---|---|---|
| 107 | P [99%] (5.2) | A-4 | +0.04 | +0.14 | −0.02 | +0.05 | Invention |
| 108 | P [99%] (5.2) | A-19 | +0.04 | +0.13 | −0.02 | +0.05 | Invention |
| 109 | P [99%] (5.2) | A-9 | +0.07 | +0.10 | −0.01 | +0.03 | Invention |
| 110 | P [99%] (5.2) | A-8 | +0.07 | +0.11 | −0.01 | +0.03 | Invention |
| 111 | P [99%] (5.2) | A-50 | +0.08 | +0.07 | −0.01 | +0.01 | Invention |
| 112 | P [99%] (5.2) | A-51 | +0.08 | +0.08 | −0.02 | +0.02 | Invention |
| 113 | P [99%] (5.2) | A-48 | +0.07 | +0.09 | −0.01 | +0.02 | Invention |
| 114 | P [99%] (5.2) | A-53 | +0.08 | +0.08 | −0.01 | +0.01 | Invention |
| 115 | P [99%] (5.2) | comparative compounds A and B | +0.02 | +0.28 | −0.04 | +0.07 | Comparison (JP-A-5-150390) |

*1The fogging of the pressurized portion shows an increment from the fogging density of the unpressurized portion.
*2The sensitivity of the pressurized portion is shown by the difference from the sensitivity of the unpressurized portion.
1) The value in is a proportion of grains having an aspect ratio of 2 or higher.
2) The value in is the maximum value of the aspect ratios.

The results of Table 2 show that the use of the compounds of the present invention makes it possible to improve durability to pressure without an reduction in sensitivity, or rather with increased sensitivity.

Further, when the aspect ratio is high (2 or higher), it is shown that the use of the compounds of the present invention represented by general formulae (A-I) to (A-V) inhibits an increase in fogging with time.

Detailed reasons for this are unknown. However, it is considered that, although the higher aspect ratio increases the surface area of emulsion grains, which resulting in susceptibleness to various changes, the use of compounds represented by formulae (A-I) to (A-V) of the present invention makes it difficult to be affected by the various changes.

EXAMPLE 2

In samples 104, 105, 107, 108, 109 and 110 of Example 1, the aspect ratios of emulsions A to H and J to L were changed as described below, and evaluation was conducted in the same manner as Example 1. As a result, similar results as Example 1 were obtained.

| | | | |
|---|---|---|---|
| A: 5.5 | B: 4.0 | C: 5.8 | D: 3.7 |
| E: 5.5 | F: 4.0 | G: 4.4 | H: 4.4 |
| J: 4.2 | K: 3.2 | L: 3.5 | |

EXAMPLE 3

1) Support

The support used in this Example was prepared as follows.

100 parts by weight of a commercially available polyethylene-2,6-naphthalate polymer and 2 parts by weight of Tinuvin P. 326 (produced by Ciba-Geigy AG) as an ultraviolet absorbent were dried by a conventional method, melted at 300° C., ejected from a T-type die, longitudinally stretched to 3.0 times at 140° C., and then transversely stretched to 3.0 times at 130° C. and thermally fixed at 250° C. for 6 seconds to provide a PEN film having a thickness of 90 μm.

A part of the film was wound around a stainless core of 20 cm in diameter and subjected to thermal hysteresis at 110° C. for 48 hours.

2) Coating of Subbing Layer

Both surfaces of the thus-obtained support were subjected to corona discharge treatment, UV discharge treatment, glow discharge treatment and flame treatment and an undercoat solution having the following composition was coated on each surface to provide a subbing layer at a side applied by a high temperature in stretching. The corona discharge treatment was conducted by means of a solid state corona treating machine, Model 6KVA, manufactured by Pillar Co., Ltd. and a support of 30 cm in width was treated at 20 m/min. According to the read values of current and voltage, the subject was treated at 0.375 KV·A·min/$m^2$. In the treatment, the discharging frequency was 9.6 KHz and the gap clearance between the electrode and the dielectric roll was 1.6 mm. The UV discharge treatment was conducted under heating at 75° C. Further, the glow discharge treatment was conducted under irradiation with a cylindrical electrode at 300 W for 30 seconds.

| | |
|---|---|
| Gelatin | 3 g |
| Distilled water | 25 ml |
| Sodium α-sulfo-di-2-ethylhexyl succinate | 0.05 g |
| Formaldehyde | 0.02 g |
| Salicylic acid | 0.1 g |
| Diacetyl cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| 3 Molar times azilidine adduct of trimethylolpropane | 0.2 g |
| 3 Molar times adduct of trimethylol propane-toluenediisocyanate | 0.2 g |
| Methanol | 15 ml |
| Acetone | 85 ml |
| Formaldehyde | 0.01 g |
| Acetic acid | 0.01 g |
| Concentrated hydrochloric acid | 0.01 g |

3) Coating of Back Layer

A back layer consisting of an antistatic layer, a magnetic recording layer and a sliding layer was provided on one surface of the above-described subbed support.

3-1) Coating of antistatic layer 3-1-1) Preparation of dispersion solution of electroconductive fine particles (dispersion solution of tin oxide-antimony oxide composite)

230 Parts by weight of stannic chloride hydrate and 23 parts by weight of antimony trichloride were dissolved in 3,000 parts by weight of ethanol to provide a uniform solution. To the resulting solution, an aqueous solution of 1 N sodium hydroxide was added dropwise until the pH of the solution reached 3 to obtain a coprecipitate of colloidal stannic oxide and antimony oxide. The resulting coprecipitate was allowed to stand at 50° C. for 24 hours and then a red brown colloidal precipitate was obtained.

The red brown colloidal precipitate was separated by a centrifuge. In order to remove excess ions, water was added to the precipitate to effect water washing by centrifugation. This procedure was repeated three times and excess ions were removed.

200 Parts by weight of the colloidal precipitate from which excess ions were removed were re-dispersed in 1,500 parts by weight of water and atomized in a calcining furnace heated at 650° C. to obtain bluish fine particle powder of a tin oxide-antimony oxide composite having an average particle diameter of 0.005 μm. The resulting fine particle powder had a specific resistance of 5 Ω·cm.

A mixed solution of 40 parts by weight of the above-described fine particle powder and 60 parts by weight of water was adjusted to have a pH of 7.0, rudely dispersed in a stirrer and then dispersed in a horizontal sand mill (Dynomill, trade name, manufactured by WILLYA BACHOFEN AG) until the residence time became 30 minutes. The secondary aggregate at this time had an average particle size of about 0.04 μm.

3-1-2) Coating of electroconductive layer

An electroconductive layer having the following formulation was coated to have a dry thickness of 0.2 μm and dried at 115° C. for 60 seconds.

| | |
|---|---|
| Dispersion solution of electroconductive fine particles prepared in 3-1-1) | 20 parts by weight |
| Gelatin | 2 parts by weight |
| Water | 27 parts by weight |
| Methanol | 60 parts by weight |
| p-Chlorophenol | 0.5 part by weight |
| Resorcin | 2 parts by weight |
| Polyoxyethylene nonylphenyl ether | 0.01 part by weight |

The resulting electroconductive film had a resistance of $1.0^{8.0}$ Ω (100 V) and revealed to have an excellent antistatic performance.

3-2) Coating of magnetic recording layer 220 g of water and 150 g of a silane coupling agent of poly(polymerization degree: 16)oxyethylene propyl trimethoxysilane were added to 1,100 g of a magnetic substance, namely, Co-doped $\gamma$-$Fe_2O_3$ (being needle-like with a longer axis of 0.14 μm and a shorter axis of 0.03 μm, having a specific surface area of 41 $m^2/g$ and a saturated magnetization of 89 emu/g, being subjected to surface treatment by an aluminum oxide and silicon oxide each in an amount of 2 wt. % of $Fe_2O_3$ and having a coercive force of 930 Oe and a $Fe^{+2}/Fe^{+3}$ ratio of 6/94) and well kneaded in an open kneader for 3 hours. The resulting rudely dispersed and viscous solution was dried over a whole day and night at 70° C. and after removing water therefrom, heated at 110° C. for 1 hour to obtain surface-treated magnetic particles.

The following formulation was kneaded again in an open kneader.

| | |
|---|---|
| Surface-treated magnetic particle prepared above | 1,000 g |
| Diacetyl cellulose | 17 g |
| Methyl ethyl ketone | 100 g |
| Cyclohexanone | 100 g |

Further, the following formulation was finely dispersed in a sand mill (1/4G) at 200 rpm for 4 hours.

| | |
|---|---|
| Kneaded product prepared above | 100 g |
| Diacetyl cellulose | 60 g |
| Methyl ethyl ketone | 300 g |
| Cyclohexanone | 300 g |

To the resulting fine dispersion, diacetyl cellulose and 3 molar times adduct of trimethylolpropane-toluenediisocyanate as a hardening agent were added in an amount of 20 wt. % based on the binder. The resulting solution was diluted with an equivalent weight of methyl ethyl ketone and cyclohexanone to have a viscosity of about 80 cp. Then, the diluted solution was coated on the above-described electroconductive layer by a bar coater to provide a film thickness of 1.2 μm and to have a magnetic substance coverage of 60 $mg/m^2$. Further, 10 $mg/m^2$ of silica particles having a particle size of 0.3 μm as a matting agent and 10 $mg/m^2$ of aluminum oxide having a size of 0.5 μm as an abrasive were added thereto. The resulting coating was dried at 115° C. for 6 minutes (rollers and the transportation apparatus in a drying zone all were heated to 115° C.).

With the use of a blue filter in Status M of X-light, the color density of the magnetic recording layer $D^8$ was increased by about 0.1. The magnetic layer had a saturated magnetization moment of 4.2 $emu/m^2$, a coercive force of 923 Oe and an angular ratio of 65%.

3-3) Preparation of sliding layer

A solution having the following formulation was coated in an amount so as to give a solid content of each compound as described below and dried at 110° C. for 5 minutes to obtain a sliding layer.

| | |
|---|---|
| Diacetyl cellulose | 25 $mg/m^2$ |
| $C_6H_{13}CH(OH)C_{10}H_{20}COOC_{40}H_{81}$ (compound a) | 6 $mg/m^2$ |
| $C_{50}H_{101}O(CH_2CH_2O)_{16}H$ (compound b) | 9 $mg/m^2$ |

A mixture of compound a and compound b (6:9) was heated in a mixed solvent of xylene and propylene glycol monomethyl ether (1:1 by volume) at 105° C. and dissolved and the resulting solution was poured in a ten-fold amount of propylene glycol monomethyl ether (25° C.) to provide a fine dispersion solution. The resulting solution was then diluted with a five-fold amount of acetone and re-dispersed in a high pressure homogenizer (200 atm) to provide a dispersion product (average particle size: 0.01 μm) and the dispersion product was used. The thus-obtained sliding layer had a performance such that the kinetic friction coefficient was 0.06 (with a stainless steel ball of 5 mmϕ, under a load of 100 g and at a speed of 6 cm/minute) and a static friction coefficient was 0.07 (by clip method) and thus, was favored with superior characteristics. Also, with respect to the sliding characteristics against the emulsion surface which will be described below, the kinematic friction coefficient was 0.12.

4) Coating of Light-Sensitive Layer

Each layer was coated in a superposed fashion on the side of a support opposite to the back layer obtained above in the same manner as in Sample 101 of Example 1.

However, 90% of the total projected area in Emulsions A to L used here had the following aspect ratio.

| | |
|---|---|
| A | 3.0 |
| B | 3.0 |
| C | 7.5 |
| D | 7.5 |
| E | 3.0 |
| F | 3.0 |
| G | 3.0 |
| H | 7.5 |
| I | 7.5 |
| J | 3.0 |
| K | 3.0 |
| L | 7.0 |

In each of these emulsions, 90% or more of grains had 40 dislocation lines per one grain.

The thus-prepared photographic material was cut into 24 mm in width and 160 cm in length and two perforations in a size of 2 $mm^2$ were made at a distance of 5.8 mm in the lengthwise direction of the photographic material on the portion 0.7 mm inside from one edge in the widthwise direction. This set of two perforations was provided at a distance of 32 mm and the thus-perforated photographic material was stored in a plastic film cartridge illustrated in FIGS. 1 to 7 of U.S. Pat. No. 5,296,887. This was designated as Sample 301.

Preparation of Sample 302

Sample 302 was prepared in the same manner as Sample 301 except that A-50 (oil soluble) was added to the fourth layer, the fifth layer, the eighth layer and the ninth layer of Sample 301 in an amount of 2 mol % based on the coated silver amount of each layer.

Preparation of Sample 303

Sample 303 was prepared in the same manner as Sample 302 except that 0.01 $g/m^2$ of A-3 (water soluble) was added to the twelfth layer of Sample 302.

The thus-obtained Samples 301 to 303 were subjected to the same evaluation as in Example 1. However, in this Example, the aging test was conducted for the photographic materials stored in a film cartridge.

Sample 302 underwent reduced fogging due to aging of the magenta and cyan images and small change in photographic properties at the pressed portion.

Sample 303 was favored with a greater improvement with respect to the magenta and cyan images and also with a great effect with respect to the yellow image. In particular, although fogging due to aging increased by providing a magnetic recording layer, the increase rate was lowered in the present invention to a non-problematic level.

The results on fog due to aging are shown in Table 3.

TABLE 3

| Sample No. | Fog due to Aging of Yellow Image | Fog due to Aging of Magenta Image | Fog due to Aging of Cyan Image | |
|---|---|---|---|---|
| 301 | +0.06 | +0.10 | +0.06 | Comparison |
| 302 | +0.06 | +0.04 | +0.03 | Invention |
| 303 | +0.02 | +0.02 | +0.01 | Invention |

EXAMPLE 4

Samples 401 to 406 were prepared in the same manner as Sample 303 of Example 3 except that Silver Iodobromide Emulsions E, F and G for the seventh layer, Silver Iodobromide Emulsion H for the eighth layer and Silver Iodobromide Emulsion I for the ninth layer of Sample 303 in Example 3 were changed as shown in Table 4.

The thus-obtained Samples 401 to 406 were subjected to the same evaluation as in Example 3.

The results obtained are shown together in Table 4 below.

TABLE 4

| Sample No. | Dislocation Line Number of Emulsions E to I | Proportion of Grains having Dislocation Line Number shown in Left Column (%) | Dislocation Line Number of Emulsions E to I | Proportion of Grains having Dislocation Line Number shown in Left Column (%) | Sensitivity of Magenta Image at Non-pressed Portion | Pressed Portion of Magenta Image: Fog | Pressed Portion of Magenta Image: Sensitivity | Fog due to Aging of Magenta Image | Remarks |
|---|---|---|---|---|---|---|---|---|---|
| 401 | 1 to 2 | 40 | 10 or more | 0 | +0.01 | +0.08 | −0.06 | 0.06 | Comparison |
| 402 | 1 to 2 | 70 | 10 or more | 0 | +0.01 | +0.08 | −0.05 | 0.06 | Comparison |
| 403 | 10 or more | 40 | 40 or more | 20 | +0.04 | +0.07 | −0.04 | 0.05 | Comparison |
| 404 | 10 or more | 70 | 40 or more | 20 | +0.16 | +0.02 | −0.02 | 0.03 | Invention |
| 405 | 10 or more | 80 | 40 or more | 40 | +0.11 | +0.04 | −0.04 | 0.04 | Invention |
| 406 | 10 or more | 90 | 40 or more | 70 | +0.16 | +0.02 | −0.02 | 0.03 | Invention |
| 303 | 10 or more | 98 | 40 or more | 80 | +0.18 | +0.02 | −0.01 | 0.02 | Invention |

It is seen from Table 4 that when the dislocation line number is 10 or more, the increase in sensitivity is large and fog at the pressed portion is small. It is also seen that as the proportion of grains having dislocation lines becomes greater, the effects increases.

TABLE 5

Samples 401A to 406A and 303A were prepared in the same manner as Samples 401 to 406 and 303 except that the coating amount of magnetic substance in the magnetic recording layer of Samples 401 to 406 and 303 in Example 4 was changed from 60 mg/m$^2$ to 110 mg/m$^2$.

Further, Samples 401B to 406B and 303B were prepared in the same manner as Samples 401 to 406 and 303 except for changing the coating amount of magnetic substance in the magnetic recording layer of Samples 401 to 406 and 303 to 0 mg/m$^2$.

Furthermore, Samples 1303, 1303A and 1303B were prepared in the same manner as Samples 303, 303A and 303B except that Compounds A-3 and A-50 of the present invention were excluded from Samples 303, 303A and 303B.

These samples were subjected to the same aging test as in Example 4 and fog due to aging of the magenta image was evaluated. The results obtained are shown together in Tables 5 to 7 below.

TABLE 5

| Sample No. | Coated Amount of Magnetic Substance (mg/m$^2$) | Emulsion Layer | Fog due to Aging of Magenta Image | Remarks |
|---|---|---|---|---|
| 401A | 110 | Same as Sample 401 | 0.08 | Comparison |
| 402A | 110 | Same as Sample 402 | 0.08 | Comparison |
| 403A | 110 | Same as Sample 403 | 0.05 | Comparison |
| 404A | 110 | Same as Sample 404 | 0.04 | Invention |
| 405A | 110 | Same as Sample 405 | 0.04 | Invention |
| 406A | 110 | Same as Sample 406 | 0.03 | Invention |
| 303A | 110 | Same as Sample 303 | 0.03 | Invention |

TABLE 6

| Sample No. | Coated Amount of Magnetic Substance (mg/m$^2$) | Emulsion Layer | Fog due to Aging of Magenta Image | Remarks |
|---|---|---|---|---|
| 401B | 0.0 | Same as Sample 401 | 0.05 | Comparison |
| 402B | 0.0 | Same as Sample 402 | 0.05 | Comparison |
| 403B | 0.0 | Same as Sample 403 | 0.04 | Comparison |
| 404B | 0.0 | Same as Sample 404 | 0.03 | Invention |
| 405B | 0.0 | Same as Sample 405 | 0.03 | Invention |
| 406B | 0.0 | Same as Sample 406 | 0.03 | Invention |
| 303B | 0.0 | Same as Sample 303 | 0.02 | Invention |

TABLE 6-continued

| Sample No. | Coated Amount of Magnetic Substance (mg/m$^2$) | Emulsion Layer | Fog due to Aging of Magenta Image | Remarks |
|---|---|---|---|---|
| | | Sample 303 | | |

TABLE 7

| Sample No. | Coated Amount of Magnetic Substance (mg/m$^2$) | Emulsion Layer | Fog due to Aging of Magenta Image | Remarks |
|---|---|---|---|---|
| 1303 | 60 | A-3 and A-50 were excluded from Sample 303 | 0.10 | Comparison |
| 1303A | 110 | A-3 and A-50 were excluded from Sample 303 | 0.14 | Comparison |
| 1303B | 0.0 | A-3 and A-50 were excluded from Sample 303 | 0.07 | Comparison |

From the results in Tables 5 to 7 and also from Table 4 in Example 4, although fogging of the photographic material increases during storage due to the coating of a magnetic substance, the fogging during storage is largely reduced by the addition of the compound according to the present invention to the emulsion layers.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one blue-sensitive silver halide emulsion layer, at least one green-sensitive silver halide emulsion layer and at least one red-sensitive silver halide emulsion layer, wherein said silver halide color photographic material comprises at least one compound selected from the group consisting of the compounds represented by one of formulas (A-I) to (A-V); and 60% or more of the total projected area of silver halide grains contained in at least one of the light-sensitive silver halide emulsion layers is occupied by tabular grains having an aspect ratio of 2 or more, and said tabular grains have a dislocation line number of 10 or more per one grain:

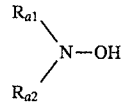

(A-I)

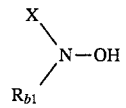

(A-II)

-continued (A-III)

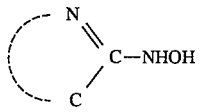

(A-IV)

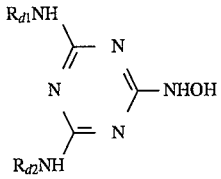

(A-V)

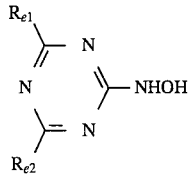

wherein in formula (A-I), $R_{a1}$ represents an alkyl group, an alkenyl group, an aryl group, an acyl group, an alkyl- or aryl-sulfonyl group, an alkyl- or aryl-sulfinyl group, a carbamoyl group, a sulfamoyl group, an alkoxycarbonyl group or an aryloxycarbonyl group, $R_{a2}$ represents a hydrogen atom or a group described for with the proviso that when $R_{a1}$ is an alkyl group, an alkenyl group or an aryl group, $R_{a2}$ is an acyl group, an alkyl- or aryl-sulfonyl group, an alkyl- or aryl-sulfinyl group, a carbamoyl group, a sulfamoyl group, an alkoxycarbonyl group or an aryloxycarbonyl group, and $R_{a1}$ and $R_{a2}$ may combine with each other to form a 5-, 6- or 7-membered ring;

in formula (A-II), X represents a heterocyclic group, $R_{b1}$ represents an alkyl group, an alkenyl group or an aryl group, and X and $R_{b1}$ may combine with each other to form a 5-, 6- or 7-membered ring;

in formula (A-III), Y represents a nonmetallic atomic group necessary for forming a five-membered ring together with —N=C—, or a nonmetallic atomic group necessary for forming a 6-membered ring together with —N=C— provided that the terminal portion of Y, bonded to the carbon atom of the —N=C— group, is a group selected from —N($R_{c1}$)—, —C($R_{c2}$)($R_{c3}$)—, —C($R_{c4}$)=, —O— and —S— (bonded to the carbon atom of —N=C— through a single bond) and $R_{c1}$, $R_{c2}$, $R_{c3}$ and $R_{c4}$ each represents a hydrogen atom or a substituent;

in formula (A-IV), $R_{d1}$ and $R_{d2}$ each represents an alkyl group or an aryl group, with the proviso that when $R_{d1}$ and $R_{d2}$ represent an unsubstituted alkyl group at the same time and $R_{d1}$ and $R_{d2}$ are the same group, $R_{d1}$ and $R_{d2}$ each is an alkyl group having 8 or more carbon atoms;

in formula (A-V), $R_{e1}$ and $R_{e2}$ each represents a hydroxylamino group, a hydroxyl group, an amino group, an alkylamino group, an arylamino group, an alkoxy group, an aryloxy group, an alkylthio group, an arylthio group, an alkyl group or an aryl group, with the proviso that $R_{e1}$ and $R_{e2}$ are not —NH$R_{e3}$ (wherein $R_{e3}$ represents an alkyl group or an aryl group) at the same time; and said compounds represented by one of formulas (A-I) to (A-V) may form bis-compounds.

2. The silver halide color photographic material as claimed in claim 1, wherein the compound selected from the group consisting of the compounds represented by one of formulas (A-I) to (A-V) is substituted by at least one substituent selected from the group consisting of an alkyl group, an alkenyl group, an aryl group, a heterocyclic group, a hydroxy group, an alkoxy group, an aryloxy group, an alkylthio group, an arylthio group, an amino group, an acylamino group, a sulfonamido group, an alkylamino group, an arylamino group, a carbamoyl group, a sulfamoyl group, —$SO_3M$, —COOM (wherein M represents H, an alkali metal atom, or $NH_4$), a halogen atom, a cyano group, a nitro group, an alkyl- or aryl-sulfonyl group, an acyl group, an alkoxycarbonyl group, an aryloxycarbonyl group, an acyloxy group and a hydroxyamino group; said substituents may be further substituted with at least one of these substituents.

3. The silver halide color photographic material as claimed in claim 1, wherein in formula (A-I), $R_{a2}$ is a hydrogen atom, an alkyl group, an alkenyl group or an aryl group, and $R_{a1}$ is an acyl group, an alkyl- or aryl-sulfonyl group, an alkyl- or aryl-sulfinyl group, a carbamoyl group, a sulfamoyl group, an alkoxycarbonyl group or an aryloxycarbonyl group.

4. The silver halide color photographic material as claimed in claim 1, wherein formula (A-I), $R_{a2}$ is an alkyl group or an alkenyl group, and $R_{a1}$ is an acyl group, an alkyl- or aryl-sulfonyl group, a carbamoyl group, a sulfamoyl group, an alkoxycarbonyl group or an aryloxycarbonyl group.

5. The silver halide color photographic material as claimed in claim 1, wherein in formula (A-I), $R_{a2}$ is an alkyl group and $R_{a1}$ is an acyl group.

6. The silver halide color photographic material as claimed in claim 1, wherein in formula (A-II), $R_{b1}$ is an alkyl group or an alkenyl group.

7. The silver halide color photographic material as claimed in claim 1, wherein in formula (A-II), $R_{b1}$ is an alkyl group.

8. The silver halide color photographic material as claimed in claim 1, wherein the compound is represented by formula (A-II-1):

(A-II-1)

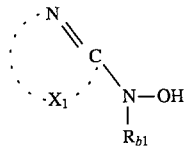

wherein $R_{b1}$ is the same as $R_{b1}$ of formula (A-II) and $X_1$ represents a nonmetallic atomic group necessary for forming a 5- or 6-membered ring with

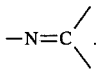

9. The silver halide color photographic material as claimed in claim 1, wherein the compound is represented by formula (A-II-2):

(A-II-2)

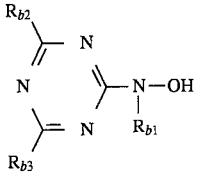

wherein $R_{b1}$ is the same as $R_{b1}$ of formula (A-II) and $R_{b2}$ and $R_{b3}$ each represents a hydrogen atom or a substituent.

10. The silver halide color photographic material as claimed in claim 9, wherein in formula (A-II-2), $R_{b2}$ and $R_{b3}$ each is a hydroxyamino group, a hydroxyl group, an amino group, an alkylamino group, an arylamino group, an alkoxy group, an aryloxy group, an alkylthio group, an arylthio group, an alkyl group or an aryl group.

11. The silver halide color photographic material as claimed in claim 1, wherein in formula (A-III), Y represents a nonmetallic atomic group necessary for forming a 5-membered ring where the end atom of Y bonded to the carbon atom of the —N=C— group is a nitrogen atom.

12. The silver halide color photographic material as claimed in claim 1, wherein in formula (A-III), Y forms an imidazoline ring which may be condensed with a benzene ring.

13. The silver halide color photographic material as claimed in claim 1, wherein in formula (A-IV), $R_{d1}$ and $R_{d2}$ each is an alkyl group.

14. The silver halide color photographic material as claimed in claim 1, wherein in formula (A-V), $R_{e1}$ and $R_{e2}$ each is a group selected from a hydroxylamino group, an alkylamino group and an alkoxy group.

15. The silver halide color photographic material as claimed in claim 1, wherein $R_{e1}$ is a hydroxylamino group and $R_{e2}$ is an alkylamino group.

16. The silver halide color photographic material as claimed in claim 1, wherein the total amount of said at least one compound is from $10^{-4}$ mmol to 10 mmol per $m^2$ of the photographic material.

17. The silver halide color photographic material as claimed in claim 1, wherein said compound is incorporated into at least one hydrophilic colloid layer provided on the support.

18. The silver halide color photographic material as claimed in claim 1, wherein said compound is incorporated into at least one of said silver halide emulsion layers.

19. The silver halide color photographic material as claimed in claim 1, wherein said aspect ratio is 3 or more.

20. The silver halide color photographic material as claimed in claim 1, wherein said dislocation line number is 20 or more.

21. The silver halide color photographic material as claimed in claim 1, wherein said total projected area is 70% or more.

22. The silver halide color photographic material as claimed in claim 1, wherein a magnetic recording layer comprising ferromagnetic powder is provided on the opposite side to said light-sensitive emulsion layer with intervention of the support there between.

23. The silver halide color photographic material as claimed in claim 22, wherein the magnetic recording layer is transparent.

24. The silver halide color photographic material as claimed in claim 22, wherein the coating amount of said ferromagnetic powder is from 10 mg to 2 g per $m^2$ of the photographic material.

* * * * *